US010760557B1

(12) United States Patent
Babcock

(10) Patent No.: US 10,760,557 B1
(45) Date of Patent: Sep. 1, 2020

(54) HIGH EFFICIENCY, HIGH PRESSURE PUMP SUITABLE FOR REMOTE INSTALLATIONS AND SOLAR POWER SOURCES

(71) Applicant: Pumptec, Inc., Anoka, MN (US)

(72) Inventor: Stephen E. Babcock, Lakeville, MN (US)

(73) Assignee: Pumptec, Inc., Anoka, MN (US)

( * ) Notice: Subject to any disclaimer, the term of this patent is extended or adjusted under 35 U.S.C. 154(b) by 244 days.

(21) Appl. No.: 15/149,067

(22) Filed: May 6, 2016

(51) Int. Cl.

| | |
|---|---|
| ***F04B 53/16*** | (2006.01) |
| ***F04B 49/02*** | (2006.01) |
| ***F04B 17/03*** | (2006.01) |
| ***F04B 17/00*** | (2006.01) |
| ***F04B 9/04*** | (2006.01) |
| ***F04B 53/14*** | (2006.01) |

(52) U.S. Cl.
CPC ..... *F04B 17/03* (2013.01); *F04B 9/042* (2013.01); *F04B 17/006* (2013.01); *F04B 49/022* (2013.01); *F04B 53/143* (2013.01); *F04B 53/16* (2013.01)

(58) Field of Classification Search
CPC ..... F04B 53/22; F04B 19/22; F04B 17/006; F04B 17/03; F04B 49/022; F04B 53/003; F04B 9/042; F04B 53/143; F04B 53/16
See application file for complete search history.

(56) References Cited

U.S. PATENT DOCUMENTS

| | | | |
|---|---|---|---|
| 1,003,479 | A | 9/1911 | Lucas |
| 1,632,948 | A | 6/1927 | Cardenas |
| 1,736,593 | A | 11/1929 | Harm |
| 1,827,811 | A | 10/1931 | Derrick |
| RE18,303 | E | 12/1931 | Harm |

(Continued)

FOREIGN PATENT DOCUMENTS

| | | | |
|---|---|---|---|
| DE | 3400263 | A1 | 7/1985 |
| DE | 3413726 | A1 | 10/1985 |

(Continued)

*Primary Examiner* — Devon C Kramer
*Assistant Examiner* — Christopher J Brunjes
(74) *Attorney, Agent, or Firm* — Albert W. Watkins

(57) ABSTRACT

A pump head has a motor coupler; a motor mount; at least one piston housing; a fluid input; a fluid output; and a reciprocating piston to pump a fluid from fluid input to fluid output. The manifold has fluid input and output bores extending parallel with the reciprocating piston, and from end to end thereof. The motor mount has a mounting flange configured to couple to a motor, and a torsion sleeve extending from the flange. A torsion bolt is coupled with the piston housing. An elastomeric sleeve isolates the torsion bolt from torsion sleeve. The torsion bolt longitudinally compresses and radially expands the elastomeric sleeve toward and against the torsion sleeve. The reciprocating piston, piston housing, a first seal, and a second seal in combination define a fluid collection chamber for fluid that leaks past the first seal. A fluid conduit connects the fluid collection chamber to the fluid input. An over-pressure release valve assembly is coupled on an input with the fluid output from the pump head, and is configured to stay closed until a predetermined maximum pressure is exceeded, and when opened will spill fluid back to at least one of the fluid inlet or a fluid reservoir.

4 Claims, 10 Drawing Sheets

(56) References Cited

U.S. PATENT DOCUMENTS 1,970,251 A 8/1934 Rossman
2,002,783 A 5/1935 Long
2,054,009 A 9/1936 Thrush
2,367,135 A 1/1945 Moon et al.
2,445,717 A 7/1948 Richards
2,668,082 A 2/1954 Pasteur
2,739,537 A 3/1956 Sadler et al.
2,881,338 A 4/1959 Banning
2,940,466 A 6/1960 Speights
2,981,025 A 4/1961 Woodson
3,067,987 A 12/1962 Ballou et al.
3,104,062 A 9/1963 Mahon
3,151,746 A 10/1964 Reustle et al.
3,209,485 A 10/1965 Griffin
3,223,040 A 12/1965 Dinkelkamp
3,266,737 A 8/1966 Nees
3,338,171 A 8/1967 Conklin et al.
3,410,477 A 11/1968 Hartley
3,487,577 A 1/1970 Sexton
3,512,375 A 5/1970 Madarasz et al.
3,513,586 A 5/1970 Meyer et al.
3,514,114 A * 5/1970 Monahan ..... F16J 15/008 277/563
3,653,784 A 4/1972 Leitermann et al.
3,664,770 A 5/1972 Palmer
3,676,949 A 7/1972 Ramsey
3,707,305 A 12/1972 Kinkelder
3,765,605 A 10/1973 Gusmer et al.
3,765,802 A 10/1973 Leitermann et al.
3,770,060 A 11/1973 Forsyth et al.
3,782,026 A 1/1974 Bridges et al.
3,787,145 A 1/1974 Keyes et al.
3,793,762 A 2/1974 Stains
3,799,402 A 3/1974 Holmes et al.
3,801,229 A 4/1974 Henderson
3,809,496 A 5/1974 Hansen
3,815,621 A 6/1974 Robinson
3,831,849 A 8/1974 Studinger
3,889,881 A 6/1975 Cunningham et al.
3,894,690 A 7/1975 Hill
3,910,497 A 10/1975 Manor
3,926,369 A 12/1975 Pearce
3,963,038 A 6/1976 Jensen
3,964,774 A 6/1976 Wollin et al.
3,967,920 A 7/1976 Hill
3,979,063 A 9/1976 Query
3,980,231 A 9/1976 Trondsen
3,993,416 A 11/1976 Kato
4,004,602 A 1/1977 Cordis et al.
4,010,768 A 3/1977 Hechler, IV
4,026,196 A 5/1977 Olofsson
4,026,439 A 5/1977 Cocks
4,028,841 A 6/1977 Lundwall
4,050,629 A 9/1977 Query et al.
4,057,072 A 11/1977 Cook
4,073,606 A 2/1978 Eller
4,076,465 A 2/1978 Pauliukonis
4,085,171 A 4/1978 Baker et al.
4,089,624 A 5/1978 Nichols et al.
4,119,113 A 10/1978 Meginniss, III
4,153,393 A 5/1979 Cook
4,167,236 A 9/1979 Taubenmann
4,185,650 A 1/1980 Neves et al.
4,186,769 A 2/1980 Buyce
4,187,173 A 2/1980 Keefer
4,191,309 A 3/1980 Alley et al.
4,199,303 A 4/1980 Bairunas et al.
4,200,426 A 4/1980 Linnert
4,234,007 A 11/1980 Titone et al.
4,236,673 A 12/1980 Lake
4,243,523 A 1/1981 Pelmulder
4,273,261 A 6/1981 Krueger
4,278,205 A 7/1981 Binoche
4,288,326 A 9/1981 Keefer
4,317,468 A 3/1982 Schwartz et al.
4,317,647 A 3/1982 Haeuser
4,341,327 A 7/1982 Zeitz
4,350,179 A 9/1982 Bunn et al.
4,360,323 A 11/1982 Anderson
4,367,140 A 1/1983 Wilson
4,427,298 A 1/1984 Fahy et al.
4,432,470 A 2/1984 Sopha
4,433,577 A 2/1984 Khurgin et al.
4,434,056 A 2/1984 Keefer
4,436,493 A 3/1984 Credle, Jr.
4,437,812 A 3/1984 Abu-Shumays et al.
4,440,314 A 4/1984 Vetter et al.
4,445,470 A 5/1984 Chmielewski
4,452,631 A 6/1984 Burow, Jr. et al.
4,486,097 A 12/1984 Riley
4,487,333 A 12/1984 Pounder et al.
4,518,105 A 5/1985 Kuckens et al.
4,534,713 A 8/1985 Wanner
4,547,128 A 10/1985 Hayes
RE32,144 E 5/1986 Keefer
4,593,855 A 6/1986 Forsyth
4,601,378 A 7/1986 Pierce et al.
4,609,149 A 9/1986 Jessen
4,609,469 A 9/1986 Keoteklian
4,629,568 A 12/1986 Ellis, III
4,638,924 A 1/1987 Newsom
4,645,599 A 2/1987 Fredkin
4,648,854 A 3/1987 Redington
4,650,792 A 3/1987 Underwood
4,699,023 A 10/1987 Bajulaz
4,705,461 A 11/1987 Clements
4,708,674 A 11/1987 Matsumoto
4,722,675 A 2/1988 Albarda
4,742,641 A 5/1988 Cretti
4,744,895 A 5/1988 Gales et al.
4,762,281 A 8/1988 Eberhardt
4,773,993 A 9/1988 Yoda et al.
4,778,356 A 10/1988 Hicks
4,778,597 A 10/1988 Bruzzi et al.
4,784,771 A 11/1988 Wathen et al.
4,789,100 A 12/1988 Senf
4,790,454 A 12/1988 Clark et al.
4,804,474 A 2/1989 Blum
4,804,475 A 2/1989 Sirinyan et al.
4,821,958 A 4/1989 Shaffer
4,850,812 A 7/1989 Voight
4,867,871 A 9/1989 Bowne
RE33,135 E 12/1989 Wanner, Sr. et al.
4,886,190 A 12/1989 Kirschner et al.
4,887,559 A 12/1989 Hensel et al.
4,913,809 A 4/1990 Sawada et al.
4,921,133 A 5/1990 Roeser
4,929,347 A 5/1990 Imai et al.
4,934,567 A 6/1990 Vahjen et al.
4,941,596 A 7/1990 Marty et al.
4,944,882 A 7/1990 Ray et al.
4,955,943 A 9/1990 Hensel et al.
4,978,284 A 12/1990 Cook et al.
4,999,209 A 3/1991 Gnekow
5,005,765 A 4/1991 Kistner
5,014,914 A 5/1991 Wallenas
5,027,978 A 7/1991 Roeser
5,055,008 A 10/1991 Daniels et al.
5,057,212 A 10/1991 Burrows
5,058,768 A 10/1991 Lichfield
5,089,124 A 2/1992 Mahar et al.
5,095,647 A 3/1992 Zobele et al.
5,100,058 A 3/1992 Wei
5,100,699 A 3/1992 Roeser
5,102,312 A 4/1992 Harvey
5,108,273 A 4/1992 Romanyszyn, Jr.
5,114,241 A 5/1992 Morrison
5,118,008 A 6/1992 Williams
5,133,483 A 7/1992 Buckles
5,170,912 A 12/1992 Du
5,173,039 A 12/1992 Cook
5,180,108 A 1/1993 Miyamoto
5,183,396 A 2/1993 Cook et al.
5,184,941 A 2/1993 King et al.

(56) References Cited

U.S. PATENT DOCUMENTS 5,192,000 A 3/1993 Wandrick et al.
5,207,916 A 5/1993 Goheen et al.
5,221,192 A 6/1993 Heflin et al.
5,228,594 A 7/1993 Aslin
5,235,944 A 8/1993 Adachi
D340,458 S 10/1993 Wang
5,253,981 A 10/1993 Yang et al.
5,255,819 A 10/1993 Peckels
5,287,833 A 2/1994 Yashiro
5,297,511 A 3/1994 Suzuki
5,303,866 A 4/1994 Hawks, Jr.
5,331,364 A 7/1994 Borden
5,332,123 A 7/1994 Farber et al.
5,333,785 A 8/1994 Dodds et al.
5,344,291 A 9/1994 Antkowiak
5,354,182 A 10/1994 Niemiec et al.
5,355,122 A 10/1994 Erickson
5,355,851 A 10/1994 Kamiya
5,368,059 A 11/1994 Box et al.
5,370,269 A 12/1994 Bernosky et al.
D354,753 S 1/1995 Turner, III et al.
5,383,605 A 1/1995 Teague
5,388,761 A 2/1995 Langeman
5,390,635 A 2/1995 Kidera et al.
5,403,490 A 4/1995 Desai
5,433,349 A 7/1995 Ramanyszyn, Jr.
5,439,592 A 8/1995 Bellos et al.
5,490,939 A 2/1996 Gerigk et al.
5,494,414 A 2/1996 Steinhart et al.
5,511,524 A 4/1996 Kidera et al.
5,538,641 A 7/1996 Getty et al.
5,542,578 A 8/1996 Buckles
5,558,435 A 9/1996 Marjo
5,558,639 A 9/1996 Gangemi et al.
5,611,172 A 3/1997 Dugan et al.
5,630,383 A 5/1997 Kidera et al.
5,636,648 A 6/1997 O'Brien et al.
5,647,973 A 7/1997 Desaulniers
5,707,219 A 1/1998 Powers
5,779,449 A 7/1998 Klein
5,785,504 A 7/1998 Cote
5,799,871 A 9/1998 Theurer
5,823,752 A * 10/1998 Hoenisch ..... F02B 63/06
184/6.17
5,829,401 A 11/1998 Masuda
5,853,122 A 12/1998 Caprio
5,855,626 A 1/1999 Wiegner et al.
5,862,947 A 1/1999 Wiegner et al.
5,876,665 A 3/1999 Zalis
5,878,708 A 3/1999 Ruman
5,879,137 A 3/1999 Yie
5,908,183 A 6/1999 Fury
5,975,152 A 11/1999 Kluge
5,975,863 A 11/1999 Mazzucato
6,003,787 A 12/1999 Fisher
6,010,032 A 1/2000 Vermylen et al.
6,012,608 A 1/2000 Ridenour
6,034,465 A 3/2000 Mckee et al.
6,036,116 A 3/2000 Bui
6,047,495 A 4/2000 Matsumura et al.
6,050,756 A 4/2000 Buchholz et al.
6,055,831 A 5/2000 Barbe
6,056,515 A 5/2000 Cuneo
6,070,764 A 6/2000 Cline et al.
6,074,551 A 6/2000 Jones et al.
6,089,835 A 7/2000 Suzuura et al.
6,098,646 A 8/2000 Hennemann et al.
6,109,361 A 8/2000 Henderson
6,110,375 A 8/2000 Bacchus et al.
6,113,797 A 9/2000 Al-Samadi
6,120,682 A 9/2000 Cook
6,139,748 A 10/2000 Ericson et al.
6,161,723 A 12/2000 Cline et al.
6,162,023 A 12/2000 Newman
6,164,560 A 12/2000 Lehrke et al.
D436,968 S 1/2001 Cook
6,186,193 B1 2/2001 Phallen et al.
6,190,556 B1 2/2001 Uhlinger
6,194,160 B1 2/2001 Levin
6,199,770 B1 3/2001 King et al.
D441,935 S 5/2001 Cook
6,247,838 B1 6/2001 Pozniak et al.
6,254,779 B1 7/2001 Jeffery et al.
6,257,843 B1 * 7/2001 Cook ..... F04B 1/02
417/360
6,276,015 B1 8/2001 Cook
6,284,171 B1 9/2001 Nonomura et al.
6,293,756 B1 9/2001 Andersson
6,302,161 B1 10/2001 Heller et al.
6,305,169 B1 10/2001 Mallof
6,328,388 B1 12/2001 Mohr et al.
6,333,018 B2 12/2001 Bianchi et al.
6,334,579 B1 1/2002 Zarbi
6,336,794 B1 1/2002 Kim
6,374,781 B1 4/2002 Kato
6,378,779 B1 4/2002 Taylor
6,386,396 B1 5/2002 Strecker
6,398,521 B1 6/2002 Yorulmazoglu
6,409,375 B1 6/2002 Knight
6,422,183 B1 7/2002 Kato
6,439,860 B1 8/2002 Greer
6,452,499 B1 9/2002 Runge et al.
6,454,190 B1 9/2002 Cook
6,464,107 B1 10/2002 Brugger
6,491,494 B1 12/2002 Beckenbach et al.
6,527,524 B2 3/2003 Cook
6,547,529 B2 4/2003 Gross
6,548,528 B2 4/2003 Kimura
6,554,577 B2 4/2003 Park et al.
6,558,078 B2 5/2003 Sowry et al.
6,568,559 B2 5/2003 Miller et al.
6,581,855 B1 6/2003 Cook
6,607,668 B2 8/2003 Rela
D480,447 S 10/2003 Cook
D480,448 S 10/2003 Cook
D481,102 S 10/2003 Marshik
6,669,105 B2 12/2003 Bryan et al.
6,696,298 B2 2/2004 Cook et al.
D488,208 S 4/2004 Cook
6,718,948 B2 4/2004 Vahle et al.
D490,496 S 5/2004 Cook
6,735,945 B1 5/2004 Hall et al.
6,739,845 B2 5/2004 Woollenweber
6,742,765 B2 6/2004 Takano et al.
6,817,486 B2 11/2004 Yang
6,823,239 B2 11/2004 Sieminski
6,824,364 B2 11/2004 Ross et al.
6,841,076 B1 1/2005 Wobben
6,857,543 B2 2/2005 Kvam et al.
6,863,036 B2 3/2005 Kato
6,893,569 B2 5/2005 Zelechonok
6,896,152 B2 5/2005 Pittman et al.
6,897,374 B2 5/2005 Garber et al.
6,921,001 B1 7/2005 Hunt et al.
6,955,760 B2 10/2005 Iwata
6,974,052 B1 12/2005 d'Hond et al.
6,997,683 B2 2/2006 Allington et al.
7,009,519 B2 3/2006 Leonard et al.
7,050,886 B2 5/2006 Oberg et al.
7,063,785 B2 6/2006 Hiraku et al.
7,066,218 B1 6/2006 Fleming et al.
7,066,353 B2 6/2006 Hammonds
7,067,061 B2 6/2006 Bosetto et al.
7,090,147 B2 8/2006 Lovett
7,141,161 B2 11/2006 Ito
7,147,827 B1 12/2006 Balisky
7,168,636 B2 1/2007 Lebeda et al.
7,207,260 B2 4/2007 Thierry et al.
7,295,898 B2 11/2007 Lovett et al.
7,395,948 B2 7/2008 Kogan
7,523,603 B2 4/2009 Hagen et al.
7,614,855 B2 11/2009 Cook
D625,388 S 10/2010 Cook
7,823,323 B2 11/2010 Su

(56) References Cited

U.S. PATENT DOCUMENTS

| | | | | |
|---|---|---|---|---|
| 7,866,512 | B2 | 1/2011 | Fertig | |
| D635,218 | S | 3/2011 | Cook | |
| 7,998,496 | B2 | 8/2011 | Su et al. | |
| 8,196,399 | B1 | 6/2012 | Hauser et al. | |
| 8,511,516 | B2 | 8/2013 | Klopfenstein et al. | |
| 9,316,216 | B1 | 4/2016 | Cook et al. | |
| 2001/0048037 | A1 | 12/2001 | Bell et al. | |
| 2002/0157413 | A1 | 10/2002 | Iwanami et al. | |
| 2002/0176788 | A1* | 11/2002 | Moutafis | A61B 17/3203 417/415 |
| 2003/0103850 | A1 | 6/2003 | Szulczewski | |
| 2003/0147755 | A1 | 8/2003 | Carter, III et al. | |
| 2003/0160525 | A1 | 8/2003 | Kimberlin et al. | |
| 2004/0033144 | A1 | 2/2004 | Rush | |
| 2004/0035949 | A1 | 2/2004 | Elkins et al. | |
| 2004/0136833 | A1 | 7/2004 | Allington et al. | |
| 2004/0162850 | A1 | 8/2004 | Sanville et al. | |
| 2004/0175278 | A1 | 9/2004 | Dexter et al. | |
| 2004/0244372 | A1 | 12/2004 | Leavesley | |
| 2004/0247461 | A1 | 12/2004 | Pflueger et al. | |
| 2004/0265144 | A1 | 12/2004 | Fukanuma et al. | |
| 2005/0019187 | A1 | 1/2005 | Whitworth et al. | |
| 2005/0254970 | A1 | 11/2005 | Mayer et al. | |
| 2006/0000854 | A1 | 1/2006 | Hornsby et al. | |
| 2006/0086823 | A1 | 4/2006 | Colarusso et al. | |
| 2006/0222524 | A1 | 10/2006 | Cook et al. | |
| 2006/0228233 | A1* | 10/2006 | Cook | F04B 17/03 417/360 |
| 2006/0261188 | A1 | 11/2006 | Ito et al. | |
| 2007/0000947 | A1 | 1/2007 | Lewis et al. | |
| 2007/0029255 | A1 | 2/2007 | D'Amato et al. | |
| 2008/0296224 | A1 | 12/2008 | Cook et al. | |
| 2009/0068034 | A1 | 3/2009 | Cook | |
| 2010/0127410 | A1 | 5/2010 | Drager | |
| 2011/0254187 | A1* | 10/2011 | Mizoguchi | B29C 45/14065 264/69 |
| 2013/0082000 | A1* | 4/2013 | d'Artenay | B01D 61/025 210/651 |
| 2014/0112812 | A1* | 4/2014 | Takemi | F04B 39/121 417/571 |

FOREIGN PATENT DOCUMENTS

| | | | |
|---|---|---|---|
| EP | 0116879 | A1 | 8/1964 |
| FR | 1293065 | A | 4/1962 |
| GB | 1202877 | A | 8/1970 |
| GB | 2235021 | A | 2/1991 |

* cited by examiner

HIGH EFFICIENCY, HIGH PRESSURE PUMP SUITABLE FOR REMOTE INSTALLATIONS AND SOLAR POWER SOURCES

BACKGROUND OF THE INVENTION

1. Field of the Invention

This invention pertains generally to pumps, and more particularly to very high pressure pumps suitable for use in remote and extreme environments, to pump diverse fluids.

2. Description of the Related Art

Fluid pumps of many diverse constructions are found in countless devices to move an equally diverse set of fluids. In fact, fluid pumps are ubiquitous with both living things and machinery.

The impellers necessary to move fluids can take on such diverse geometries as one or more inclined blades spinning about a hub and either propelling the fluid axially or radially with respect to the spin axis, a piston reciprocating within a sleeve or cylinder, a gear pair that rotates to separate on an intake side and mesh on a discharge side, a screw turning within a cylinder, a rotary vane, a diaphragm that moves to change the volume of a chamber, a collapsible tube pinched in a progressive manner by an external object or roller, gas bubbles rising in a liquid, gravity moving a liquid from a higher point of elevation to a lower elevation, ions driven by an electrical field, magnetic particles or objects driven by a magnetic field, and others. There are, quite plainly, many diverse geometries and constructions of fluid impellers.

The fluids that are pumped may be even more diverse, ranging from gases such as air or other gases moved by a fan, to low viscosity liquids such as water, and to viscous liquids such as oils and greases pumped within machinery. In the modern world, many different procedures and chemical compositions have been developed that improve a process, formulation, or operation, and rather than manually carrying out these procedures and delivering these compositions, in most cases a mechanized pump will do the work.

There are many different characteristics that can be measured to both define the pump and also determine the suitability of the pump for different applications. A few common characteristics are: flow rate, both with no outlet pressure and at various outlet pressures; inlet suction; maximum outlet pressure; horsepower or equivalent energy consumption; pump complexity; initial pump cost; required pump maintenance; and expected operating life usually measured as Mean Time Between Failure (MTBF). Other characteristics can be estimated or calculated therefrom as well, such as pump efficiency and annual operating cost. Pump efficiency is defined as the ratio of the kinetic power imparted on the fluid by the pump in relation to the power supplied to drive the pump, which can be determined from the energy consumed to generate a flow rate at a pressure head. Other exemplary metrics that may be less common but which may be important or critical for some applications include: compatibility with one or many different fluids, including but not limited to slurries, chemical compositions, and varying viscosities; consistency of output through varying pressure heads; conservation of fluid being pumped; mechanical shear; priming requirements; consistency of output flow rate and pressure; starting current and torque; suitable energy sources for driving the pump; and other factors.

For different applications, these characteristics are often times quite divergent from other applications. For exemplary purpose, a washing machine drain pump has very low pressure head required, typically only lifting the drain water from a few inches to a few feet, and will preferably be of simple construction, have low initial fabrication cost, will have a long MTBF, and will require little maintenance. However, the drain water may include somewhat corrosive compositions such as sodium hypochlorite (chlorine bleach) and powerful detergents that will quickly dissolve grease used in many pump seals. Further, there may be relatively large particles that pass through the washing machine drum along with the water, such as small pins, nails, screws, sand, and other solid objects, that must be pumped without consequential harm or stoppage of the pump. As has been known in the art of washing machines, a simple centrifugal or radial vane pump may be used to meet all of these objectives. However, such a pump will be unable to generate much in the way a greater pressure head, and consequently the output and pump efficiency will vary greatly with changes in pressure head.

In many fluid applications, such as chemical applications, one or more fluids must be mixed with one or more additional fluids to achieve a desired fluid mixture. Commonly, mixing one fluid with another fluid is performed by measuring out a quantity of a first fluid, measuring out a quantity of a second fluid, and combining the measured amounts in a container where the fluids are mixed together. This process is routinely performed by hand, and thus is subject to inaccuracies attributed to human error. Thus, the fluid mixture achieved may not in fact possess the precise desired proportions of the fluids. Additionally, as fluid mixtures are typically mixed in batches (i.e., discrete quantities of a fluid mixture), inconsistencies in the proportions of the mixed fluids from one batch to the next batch may be experienced.

Many artisans over the years have applied various technologies to improve various facets of pumps and to expand the applicability of pumps into industries and applications not previously well addressed. The following patents are incorporated herein by reference as exemplary of the state of the art in a variety of fields, various advances being made therein, and for the teachings and illustrations found therein which provide a foundation and backdrop for the technology of the present invention. The following list is not to be interpreted as determining relevance or analogy, but is instead in some instances provided solely to illustrate levels of skill in various fields to which the present invention pertains: U.S. Pat. No. 1,003,479 by Lucas, entitled "Pump valve"; U.S. Pat. No. 1,632,948 by Cardenas, entitled "Water pump"; U.S. Pat. No. 1,736,593 by Harm, entitled "Circulating device"; U.S. Pat. No. 1,827,811 by Derrick, entitled "Bearing for rotary pumps"; U.S. Pat. No. 1,970,251 by Rossman, entitled "Mechanical movement"; U.S. Pat. No. 2,002,783 by Long, entitled "Valve"; U.S. Pat. No. 2,054,009 by Thrush, entitled "Flexible coupling"; U.S. Pat. No. 2,367,135 by Moon et al, entitled "Tree spraying apparatus"; U.S. Pat. No. 2,739,537 by Sadler et al, entitled "Motor driven pump"; U.S. Pat. No. 2,881,338 by Banning, entitled "Variable speed alternating current motor"; U.S. Pat. No. 3,067,987 by Ballou et al, entitled "Two-component mixer"; U.S. Pat. No. 3,223,040 by Dinkelkamp, entitled "Two component pumping and proportioning system"; U.S. Pat. No. 3,338,171 by Conklin et al, entitled "Pneumatically operable diaphragm pumps"; U.S. Pat. No. 3,410,477 by Hartley, entitled "Vacuum pump"; U.S. Pat. No. 3,512,375 by Madarasz et al, entitled "Flexible coupling for shafts";

U.S. Pat. No. 3,653,784 by Leitermann et al, entitled "Proportionating feed pump"; U.S. Pat. No. 3,664,770 by Palmer, entitled "Diaphragm pumps"; U.S. Pat. No. 3,707,305 by Kinkelder, entitled "Automatic spray fluid control device"; U.S. Pat. No. 3,765,605 by Gusmer et al, entitled "Apparatus for ejecting a mixture of liquids"; U.S. Pat. No. 3,765,802 by Leitermann et al, entitled "Feed and proportioning pump"; U.S. Pat. No. 3,770,060 by Forsyth et al, entitled "Modular Firefighting unit"; U.S. Pat. No. 3,787,145 by Keyes et al, entitled "Mixing pump assembly"; U.S. Pat. No. 3,799,402 by Holmes et al, entitled "Liquid proportioning system"; U.S. Pat. No. 3,801,229 by Henderson, entitled "Combined motor and rotary fluid device"; U.S. Pat. No. 3,815,621 by Robinson, entitled "Proportioning pump"; U.S. Pat. No. 3,831,849 by Studinger, entitled "Mobile self contained pressure sprayer"; U.S. Pat. No. 3,894,690 by Hill, entitled "Horticulture spraying systems"; U.S. Pat. No. 3,910,497 by Manor, entitled "Hydraulic valve operator and remote control"; U.S. Pat. No. 3,963,038 by Jensen, entitled "Liquid proportioning pump"; U.S. Pat. No. 3,967,920 by Hill, entitled "Horticulture spraying systems"; U.S. Pat. No. 3,980,231 by Trondsen, entitled "Proportioning sprayer device"; U.S. Pat. No. 4,004,602 by Cordis et al, entitled "Self-metering dual proportioner"; U.S. Pat. No. 4,010,768 by Hechler IV, entitled "Two-stage jet pump proportioner"; U.S. Pat. No. 4,026,196 by Olofsson, entitled "Device for driving a pump piston"; U.S. Pat. No. 4,026,439 by Cocks, entitled "Precision fluid dispensing and mixing system"; U.S. Pat. No. 4,073,606 by Eller, entitled "Pumping installation"; U.S. Pat. No. 4,076,465 by Pauliukonis, entitled "Volumetric proportioning diluter"; U.S. Pat. No. 4,089,624 by Nichols et al, entitled "Controlled pumping system"; U.S. Pat. No. 4,119,113 by Meginniss III, entitled "Double-action proportioning pump"; U.S. Pat. No. 4,167,236 by Taubenmann, entitled "Apparatus for the feeding of liquid synthetic resin components"; U.S. Pat. No. 4,186,769 by Buyce, entitled "Liquid mixing and delivering aparatus"; U.S. Pat. No. 4,187,173 by Keefer, entitled "Reverse osmosis method and apparatus"; U.S. Pat. No. 4,191,309 by Alley et al, entitled "Product portioning in the continuous pumping of plastic materials"; U.S. Pat. No. 4,199,303 by Bairunas et al, entitled "Feeder for apparatus for ejecting a mixture of a plurality of liquids"; U.S. Pat. No. 4,200,426 by Linnert, entitled "Hermetic compressor assembly including torque reaction leaf spring means"; U.S. Pat. No. 4,234,007 by Titone et al, entitled "Automatic liquid flow control device"; U.S. Pat. No. 4,236,673 by Lake, entitled "Portable power operated chemical spray apparatus"; U.S. Pat. No. 4,243,523 by Pelmulder, entitled "Water purification process and system"; U.S. Pat. No. 4,273,261 by Krueger, entitled "Metering apparatus"; U.S. Pat. No. 4,278,205 by Binoche, entitled "Constant flow rate fluid supply device, particularly for a spray gun"; U.S. Pat. No. 4,288,326 by Keefer, entitled "Rotary shaft driven reverse osmosis method and apparatus"; U.S. Pat. No. 4,317,468 by Schwartz et al, entitled "Pressure relief valve"; U.S. Pat. No. 4,317,647 by Haeuser, entitled "Dosing system"; U.S. Pat. No. 4,341,327 by Zeitz, entitled "Digital proportional metering pumping system"; U.S. Pat. No. 4,350,179 by Bunn et al, entitled "Valve assembly with relief groove"; U.S. Pat. No. 4,360,323 by Anderson, entitled "Proportioning pumping system for dialysis machines"; U.S. Pat. No. 4,367,140 by Wilson, entitled "Reverse osmosis liquid purification apparatus"; U.S. Pat. No. 4,427,298 by Fahy et al, entitled "Method and system for accurately providing fluid blends"; U.S. Pat. No. 4,432,470 by Sopha, entitled "Multicomponent liquid mixing and dispensing assembly"; U.S. Pat. No. 4,434,056 by Keefer, entitled "Multi-cylinder reverse osmosis apparatus and method"; U.S. Pat. No. 4,436,493 by Credle, Jr., entitled "Self contained pump and reversing mechanism therefor"; U.S. Pat. No. 4,437,812 by Abu-Shumays et al, entitled "Single-pump multiple stroke proportioning for gradient elution liquid chromatography"; U.S. Pat. No. 4,440,314 by Vetter et al, entitled "Method and apparatus for the automatic dynamic dosing at least of one fluid component of a mixed fluid"; U.S. Pat. No. 4,445,470 by Chmielewski, entitled "Oil injection warning system"; U.S. Pat. No. 4,452,631 by Burow, Jr. et al, entitled "Urea herbicides"; U.S. Pat. No. 4,486,097 by Riley, entitled "Flow analysis"; U.S. Pat. No. 4,487,333 by Pounder et al, entitled "Fluid dispensing system"; U.S. Pat. No. 4,518,105 by Kuckens et al, entitled "Method of and device for dispensing viscous concentrates of variable viscosity in accurately metered quantities of variable volume"; U.S. Pat. No. 4,534,713 by Wanner, entitled "Pump apparatus"; U.S. Pat. No. 4,593,855 by Forsyth, entitled "Vehicle-mountable fire fighting apparatus"; U.S. Pat. No. 4,601,378 by Pierce et al, entitled "Supporting bracket for hydraulic pump and clutch"; U.S. Pat. No. 4,609,149 by Jessen, entitled "Injection gun system for lawn treatment"; U.S. Pat. No. 4,609,469 by Keoteklian, entitled "Method for treating plant effluent"; U.S. Pat. No. 4,629,568 by Ellis III, entitled "Fluid treatment system"; U.S. Pat. No. 4,645,599 by Fredkin, entitled "Filtration apparatus"; U.S. Pat. No. 4,648,854 by Redington, entitled "Variable speed drive"; U.S. Pat. No. 4,699,023 by Bajulaz, entitled "Mechanical reducer"; U.S. Pat. No. 4,705,461 by Clements, entitled "Two-component metering pump"; U.S. Pat. No. 4,708,674 by Matsumoto, entitled "Separate lubricating system for marine propulsion device"; U.S. Pat. No. 4,722,675 by Albarda, entitled "Piston proportioning pump"; U.S. Pat. No. 4,744,895 by Gales et al, entitled "Reverse osmosis water purifier"; U.S. Pat. No. 4,762,281 by Eberhardt, entitled "Drive arrangements for comminutor-pump assembly"; U.S. Pat. No. 4,773,993 by Yoda et al, entitled "Apparatus for purifying and dispensing water with stagnation preventing means"; U.S. Pat. No. 4,778,356 by Hicks, entitled "Diaphragm pump"; U.S. Pat. No. 4,778,597 by Bruzzi et al, entitled "Process for the separation and recovery of boron compounds from a geothermal brine"; U.S. Pat. No. 4,784,771 by Wathen et al, entitled "Method and apparatus for purifying fluids"; U.S. Pat. No. 4,789,100 by Senf, entitled "Multiple fluid pumping system"; U.S. Pat. No. 4,790,454 by Clark et al, entitled "Self-contained apparatus for admixing a plurality of liquids"; U.S. Pat. No. 4,804,474 by Blum, entitled "Energy efficient dialysis system"; U.S. Pat. No. 4,804,475 by Sirinyan et al, entitled "Metallized membrane systems"; U.S. Pat. No. 4,821,958 by Shaffer, entitled "Mobile pressure cleaning unit"; U.S. Pat. No. 4,850,812 by Voight, entitled "Integrated motor pump combination"; U.S. Pat. No. 4,887,559 by Hensel et al, entitled "Solenoid controlled oil injection system for two cycle engine"; U.S. Pat. No. 4,913,809 by Sawada et al, entitled "Concentrating apparatus with reverse osmosis membrane"; U.S. Pat. No. 4,921,133 by Roeser, entitled "Method and apparatus for precision pumping, ratioing and dispensing of work fluids"; U.S. Pat. No. 4,929,347 by Imai et al, entitled "Concentrating apparatus with reverse osmosis membrane"; U.S. Pat. No. 4,934,567 by Vahjen et al, entitled "Hybrid beverage mixing and dispensing system"; U.S. Pat. No. 4,941,596 by Marty et al, entitled "Mixing system for use with concentrated liquids"; U.S. Pat. No. 4,944,882 by Ray et al, entitled "Hybrid membrane separation systems"; U.S. Pat. No. 4,955,943 by Hensel et al, entitled "Metering pump controlled oil injection system for two cycle engine";

U.S. Pat. No. 4,999,209 by Gnekow, entitled "Low and non-alcoholic beverages produced by simultaneous double reverse osmosis"; U.S. Pat. No. 5,005,765 by Kistner, entitled "Method and apparatus for applying multicomponent materials"; U.S. Pat. No. 5,014,914 by Wallenas, entitled "Dose control apparatus for agricultural tube sprayers for spreading pesticides on fields and plants"; U.S. Pat. No. 5,027,978 by Roeser, entitled "Method and apparatus for precision pumping, ratioing, and dispensing of work fluid(s)"; U.S. Pat. No. 5,055,008 by Daniels et al, entitled "Proportionating pump for liquid additive metering"; U.S. Pat. No. 5,057,212 by Burrows, entitled "Water conductivity monitor and circuit with extended operating life"; U.S. Pat. No. 5,058,768 by Lichfield, entitled "Methods and apparatus for dispensing plural fluids in a precise proportion"; U.S. Pat. No. 5,089,124 by Mahar et al, entitled "Gradient generation control for large scale liquid chromatography"; U.S. Pat. No. 5,100,058 by Wei, entitled "Self-contained cleaning system for motor vehicles"; U.S. Pat. No. 5,100,699 by Roeser, entitled "Method and apparatus for precision pumping, ratioing, and dispensing of work fluid(s)"; U.S. Pat. No. 5,102,312 by Harvey, entitled "Pump head"; U.S. Pat. No. 5,108,273 by Romanyszyn, entitled "Helical metering pump having different sized rotors"; U.S. Pat. No. 5,114,241 by Morrison, entitled "Device for insulating motor stators"; U.S. Pat. No. 5,118,008 by Williams, entitled "Programmable additive controller"; U.S. Pat. No. 5,133,483 by Buckles, entitled "Metering system"; U.S. Pat. No. 5,170,912 by Du, entitled "Proportioning pump"; U.S. Pat. No. 5,173,039 by Cook, entitled "Double acting simplex plunger pump"; U.S. Pat. No. 5,180,108 by Miyamoto, entitled "Truck with a power spray device"; U.S. Pat. No. 5,183,396 by Cook et al, entitled "Double acting simplex plunger pump"; U.S. Pat. No. 5,184,941 by King et al, entitled "Mounting support for motor-pump unit"; U.S. Pat. No. 5,192,000 by Wandrick et al, entitled "Beverage dispenser with automatic ratio control"; U.S. Pat. No. 5,207,916 by Goheen et al, entitled "Reverse osmosis system"; U.S. Pat. No. 5,221,192 by Heflin et al, entitled "Elastomeric compressor stud mount"; U.S. Pat. No. 5,228,594 by Aslin, entitled "Metered liquid dispensing system"; U.S. Pat. No. 5,235,944 by Adachi, entitled "Engine lubricating system"; U.S. Pat. No. 5,253,981 by Yang et al, entitled "Multichannel pump apparatus with microflow rate capability"; U.S. Pat. No. 5,255,819 by Peckels, entitled "Method and apparatus for manual dispensing from discrete vessels with electronic system control and dispensing data generation on each vessel, data transmission by radio or interrogator, and remote data recording"; U.S. Pat. No. 5,287,833 by Yashiro, entitled "Lubricating oil supplying system for two cycle engine"; U.S. Pat. No. 5,297,511 by Suzuki, entitled "Lubricating system for engine"; U.S. Pat. No. 5,303,866 by Hawks, entitled "Integrated modular spraying system"; U.S. Pat. No. 5,332,123 by Farber et al, entitled "Device for the measured dispensing of liquids out of a storage container and synchronous mixing with a diluent"; U.S. Pat. No. 5,344,291 by Antkowiak, entitled "Motor pump power end interconnect"; U.S. Pat. No. 5,354,182 by Niemiec et al, entitled "Unitary electric-motor/hydraulic-pump assembly with noise reduction features"; U.S. Pat. No. 5,355,851 by Kamiya, entitled "Lubricating oil supplying system for two cycle engine"; U.S. Pat. No. 5,368,059 by Box et al, entitled "Plural component controller"; U.S. Pat. No. 5,370,269 by Bernosky et al, entitled "Process and apparatus for precise volumetric diluting/mixing of chemicals"; U.S. Pat. No. 5,383,605 by Teague, entitled "Radio controlled spraying device"; U.S. Pat. No. 5,390,635 by Kidera et al, entitled "Lubricating oil supplying system for engine"; U.S. Pat. No. 5,403,490 by Desai, entitled "Process and apparatus for removing solutes from solutions"; U.S. Pat. No. 5,433,349 by Romanyszyn, entitled "Mixing and flushing device for juice dispensing tower"; U.S. Pat. No. 5,439,592 by Bellos et al, entitled "Method for removal of water soluble organics from oil process water"; U.S. Pat. No. 5,490,939 by Gerigk et al, entitled "Process for reconcentrating overspray from one-component coating compositions"; U.S. Pat. No. 5,494,414 by Steinhart et al, entitled "Vertical shaft pressure washer coupling assembly"; U.S. Pat. No. 5,511,524 by Kidera et al, entitled "Lubricating oil supplying system for engine"; U.S. Pat. No. 5,538,641 by Getty et al, entitled "Process for recycling laden fluids"; U.S. Pat. No. 5,542,578 by Buckles, entitled "Dispensing gun for ratio sensitive two-part material"; U.S. Pat. No. 5,558,435 by Marjo, entitled "System for mixing liquids"; U.S. Pat. No. 5,630,383 by Kidera et al, entitled "Lubricating oil supplying system for engine"; U.S. Pat. No. 5,636,648 by O'Brien et al, entitled "Mobile rotator jet sewer cleaner"; U.S. Pat. No. 5,647,973 by Desaulniers, entitled "Reverse osmosis filtration system with concentrate recycling controlled by upstream conductivity"; U.S. Pat. No. 5,707,219 by Powers, entitled "Diaphragm pump"; U.S. Pat. No. 5,779,449 by Klein, entitled "Separable, multipartite impeller assembly for centrifugal pumps"; U.S. Pat. No. 5,785,504 by Cote, entitled "Pump with separate pumping stages for pumping a plurality of liquids"; U.S. Pat. No. 5,823,752 by Hoenisch et al, entitled "Adapter for mechanically coupling a pump and a prime mover"; U.S. Pat. No. 5,829,401 by Masuda, entitled "Lubrication system for two-cycle engine"; U.S. Pat. No. 5,855,626 by Wiegner et al, entitled "Method for mixing and dispensing oxygen degradable hair dye concentrates"; U.S. Pat. No. 5,862,947 by Wiegner et al, entitled "Hair dye color selection system and method"; U.S. Pat. No. 5,878,708 by Ruman, entitled "Oil management system for a fuel injected engine"; U.S. Pat. No. 5,879,137 by Yie, entitled "Method and apparatus for pressurizing fluids"; U.S. Pat. No. 5,908,183 by Fury, entitled "Precision power coupling housing"; U.S. Pat. No. 5,975,152 by Kluge, entitled "Fluid container filling apparatus"; U.S. Pat. No. 5,975,863 by Mazzucato, entitled "High pressure water pump system"; U.S. Pat. No. 6,012,608 by Ridenour, entitled "Storage and metering system for supersaturated feed supplements"; U.S. Pat. No. 6,034,465 by McKee et al, entitled "Pump driven by brushless motor"; U.S. Pat. No. 6,050,756 by Buchholz et al, entitled "Method of cooling and lubricating a tool and/or workpiece and a working spindle for carrying out the method"; U.S. Pat. No. 6,055,831 by Barbe, entitled "Pressure sensor control of chemical delivery system"; U.S. Pat. No. 6,056,515 by Cuneo, entitled "Hydrocleaning machine with pump mounting closure lid"; U.S. Pat. No. 6,070,764 by Cline et al, entitled "Apparatus for dispensing liquids and solids"; U.S. Pat. No. 6,074,551 by Jones et al, entitled "Automatic cleaning system for a reverse osmosis unit in a high purity water treatment system"; U.S. Pat. No. 6,098,646 by Hennemann et al, entitled "Dispensing system with multi-port valve for distributing use dilution to a plurality of utilization points and position sensor for use thereon"; U.S. Pat. No. 6,110,375 by Bacchus et al, entitled "Process for purifying water"; U.S. Pat. No. 6,113,797 by Al-Samadi, entitled "High water recovery membrane purification process"; U.S. Pat. No. 6,120,682 by Cook, entitled "Portable pump-type reverse osmosis apparatus"; U.S. Pat. No. 6,139,748 by Ericson et al, entitled "Method and device for monitoring an infusion pump"; U.S. Pat. No. 6,162,023 by Newman, entitled "Reciprocating cam actuation mechanism for a pump"; U.S. Pat. No. 6,164,560 by Lehrke et al, entitled "Lawn applicator module and control system therefor"; U.S. Pat. No. 6,186,193 by Phallen et al, entitled "Continuous liquid stream digital blending system"; U.S. Pat. No. 6,190,556 by Uhlinger, entitled "Desalination method and apparatus utilizing nanofiltration and reverse osmosis membranes"; U.S. Pat. No. 6,247,838 by Pozniak et al, entitled "Method for producing a liquid mixture having a predetermined concentration of a specified component"; U.S. Pat. No. 6,254,779 by Jeffery et al, entitled "Treatment of effluent streams containing organic acids"; U.S. Pat. No. 6,257,843 by Cook et al, entitled "Self-aligning double-acting simplex plunger pump"; U.S. Pat. No. 6,284,171 by Nonomura et al, entitled "Blow molding process"; U.S. Pat. No. 6,293,756 by Andersson, entitled "Pump"; U.S. Pat. No. 6,305,169 by Mallof, entitled "Motor assisted turbocharger"; U.S. Pat. No. 6,328,388 by Mohr et al, entitled "Brake actuation unit"; U.S. Pat. No. 6,333,018 by Bianchi et al, entitled "Process for the industrial production of high purity hydrogen peroxide"; U.S. Pat. No. 6,336,794 by Kim, entitled "Rotary compressor assembly with improved vibration suppression"; U.S. Pat. No. 6,374,781 by Kato, entitled "Oil injection lubrication system for two-cycle engines"; U.S. Pat. No. 6,386,396 by Strecker, entitled "Mixing rotary positive displacement pump for micro dispensing"; U.S. Pat. No. 6,398,521 by Yorulmazoglu, entitled "Adapter for motor and fluid pump"; U.S. Pat. No. 6,409,375 by Knight, entitled "Precision injected liquid chemical mixing apparatus"; U.S. Pat. No. 6,422,183 by Kato, entitled "Oil injection lubrication system and methods for two-cycle engines"; U.S. Pat. No. 6,439,860 by Greer, entitled "Chambered vane impeller molten metal pump"; U.S. Pat. No. 6,464,107 by Brugger, entitled "Dosage dispenser"; U.S. Pat. No. 6,491,494 by Beckenbach et al, entitled "Direct drive water pump"; U.S. Pat. No. 6,527,524 by Cook, entitled "Double acting simplex plunger pump with bi-directional valves"; U.S. Pat. No. 6,554,577 by Park et al, entitled "Apparatus and method for controlling operation of linear compressor using pattern recognition"; U.S. Pat. No. 6,568,559 by Miller et al, entitled "Termite control system with multi-fluid proportion metering and batch signal metering"; U.S. Pat. No. 6,607,668 by Rela, entitled "Water purifier"; U.S. Pat. No. 6,696,298 by Cook et al, entitled "Multi-channel reagent dispensing apparatus"; U.S. Pat. No. 6,735,945 by Hall et al, entitled "Electric turbocharging system"; U.S. Pat. No. 6,739,845 by Woollenweber, entitled "Compact turbocharger"; U.S. Pat. No. 6,742,765 by Takano et al, entitled "Operating device and valve system"; U.S. Pat. No. 6,817,486 by Yang, entitled "Photoresist supply apparatus capable of controlling flow length of photoresist and method of supplying photoresist using the same"; U.S. Pat. No. 6,824,364 by Ross et al, entitled "Master/slave pump assembly employing diaphragm pump"; U.S. Pat. No. 6,841,076 by Wobben, entitled "Method and device for desalting water"; U.S. Pat. No. 6,857,543 by Kvam et al, entitled "Low volume dispense unit and method of using"; U.S. Pat. No. 6,863,036 by Kato, entitled "Lubrication system for two-cycle engine"; U.S. Pat. No. 6,893,569 by Zelechonok, entitled "Method and apparatus for high pressure liquid chromatography"; U.S. Pat. No. 6,896,152 by Pittman et al, entitled "Electronic plural component proportioner"; U.S. Pat. No. 6,974,052 by d'Hond et al, entitled "Dosing device adapted for dispensing a concentrate from a holder in a metered manner"; U.S. Pat. No. 6,997,683 by Allington et al, entitled "High pressure reciprocating pump and control of the same"; U.S. Pat. No. 7,050,886 by Oberg et al, entitled "Chemical dispensing system for a portable concrete plant"; U.S. Pat. No. 7,063,785 by Hiraku et al, entitled "Pump for liquid chromatography"; U.S. Pat. No. 7,066,353 by Hammonds, entitled "Fluid powered additive injection system"; U.S. Pat. No. 7,067,061 by Bosetto et al, entitled "Method and a device for preparing a medical liquid"; U.S. Pat. No. 7,141,161 by Ito, entitled "Gradient pump apparatus"; U.S. Pat. No. 7,147,827 by Balisky, entitled "Chemical mixing, replenishment, and waste management system"; U.S. Pat. No. 7,207,260 by Thierry et al, entitled "Reciprocating hydraulic machine, especially a motor, and dosing apparatus comprising such a motor"; U.S. Pat. No. 7,823,323 by Su, entitled "Remote monitoring system for detecting termites"; U.S. Pat. No. 9,316,216 by Cook et al, entitled "Proportioning Pump, Control Systems and Applicator Apparatus"; RE 18,303 by Harm, entitled "Circulating device"; RE 32,144 by Keefer, entitled "Reverse osmosis method and apparatus"; RE 33,135 by Wanner, Sr., deceased et al, entitled "Pump apparatus"; 2002/0157413 by Iwanami et al, entitled "Compressor driven selectively by first and second drive sources"; 2003/0103850 by Szulczewski, entitled "Axial piston pump/motor with clutch and through shaft"; 2003/0147755 by Carter, III et al, entitled "Dual drive for hydraulic pump and air boost compressor"; 2003/0160525 by Kimberlin et al, entitled "Motor pump with balanced motor rotor"; 2004/0033144 by Rush, entitled "Decoupling mechanism for hydraulic pump/motor assembly"; 2004/0136833 by Allington et al, entitled "High pressure reciprocating pump and control of the same"; 2004/0175278 by Dexter et al, entitled "Pressure washer having oilless high pressure pump"; 2004/0244372 by Leavesley, entitled "Turbocharger apparatus"; 2004/0247461 by Pflueger et al, entitled "Two stage electrically powered compressor"; 2004/0265144 by Fukanuma et al, entitled "Hybrid compressor"; 2005/0019187 by Whitworth et al, entitled "Internal screw positive rod displacement metering pump"; 2005/0254970 by Mayer et al, entitled "Quick connect pump to pump mount and drive arrangement"; 2006/0228233 by Cook, entitled "Pump and motor assembly"; 2007/0029255 by D'Amato et al, entitled "Desalination system powered by renewable energy source and methods related thereto"; 2008/0296224 by Cook et al, entitled "Reverse osmosis pump system"; 2009/0068034 by Cook, entitled "Pumping system with precise ratio output"; and 2010/0127410 by Drager, entitled "Method and device for the metered release of irritants".

In addition to the foregoing patents, Webster's New Universal Unabridged Dictionary, Second Edition copyright 1983, is incorporated herein by reference in entirety for the definitions of words and terms used herein.

A challenging application for a pump is chemical injection. These types of pumps are commonly known as chemical injection pumps. Chemical injection pumps are used to inject relatively small or precise amounts of chemicals into process streams. For exemplary purposes only, these chemicals might include surfactants, solvents, chemical reagents, catalysts, emulsifiers and de-emulsifiers, salinating and desalinating agents, anti-freeze, corrosion and scale inhibitors, biocides, clarifiers, oxidizers, and antioxidants. The process stream may be at very high pressure, or the injector may preferably be supplied with very high pressure to improve the distribution, diffusion, or vaporization of the chemical into the process stream. Either of these requirements of high precision or high pressure will eliminate many types of impellers, and will therefore mandate a much smaller subset of pump types and geometries.

One extraordinarily demanding application for chemical injection pumps is in the oil and gas industry. This is because oil and gas pipelines may extend for hundreds or even thousands of miles, meaning the ambient temperatures may be very different at different locations along the pipeline. Further, these pipelines will also commonly run through regions of little or no human population, making them not only remote, but also not provided with nearby electrical transmission lines to power equipment. The pipelines may run at very high pressure, mandating pumps capable of handling the substantial head required to properly supply the pipeline. In addition, there are many different chemicals that may be desired to be injected into the pipeline.

One common example of the use of a chemical injection pump is the injection of methanol into a natural gas pipeline to reduce or eliminate the formation of hydrates. Hydrates can freeze at almost thirty degrees Fahrenheit above the freezing point of water. Left untreated, the water content of even "dry" natural gas can cause blockage in the pipeline or seriously interfere with instrumentation or other vital components. As a practical example, gas flowing in a pipeline at relatively higher pressures such as 700 psi at an ambient temperature of 60 degrees Fahrenheit may have no issue with freezing. However, through distribution there may be a pressure regulating station that drops the pressure substantially, and associated with this pressure drop is a temperature drop. If the temperature drop and water vapor content are sufficient, the pressure regulator or adjacent components may freeze.

Many other chemicals besides methanol may be injected into the pipeline, including but not limited to de-emulsifiers, solvents, de-salting agents, corrosion inhibitors, biocides, clarifiers, scale inhibitors, paraffin dewaxers, surfactants, oxygen scavengers, and hydrogen sulfide scavengers. Consequently, a chemical injection pump designed for a gas pipeline must not only withstand very high pressure heads and temperature extremes, it must also be extremely chemical resistant.

In consideration of the remote nature of these pumps, lack of access to external power sources, and the ready availability of gas that is highly pressurized relative to atmosphere, many of these pumps have historically been pneumatically powered by pressurized fuel gas. There are a number of benefits, including low initial capital outlay, operation in remote locations without a need for electrical infrastructure, ready commercial availability, typically a simple design that allows both a higher MTBF and simpler and lower cost maintenance and repair, and a labor force experienced in the installation and maintenance of pneumatic pumps. However, the operating costs including spent fuel gas are much higher, and the emission of fuel gas is undesirable as a fire hazard, a worker safety hazard, and a greenhouse gas emission.

As a result of the drawbacks associated with pneumatic pumps, other pumps have been sought after to overcome the disadvantages. Solar powered chemical injection pumps are one such alternative. However, conversion at larger facilities still requires a large output of capital, infrastructure change, and personnel training. Consequently, a solar powered pump must provide significant economic and environmental advantage to be economically viable.

SUMMARY OF THE INVENTION

In one manifestation, the invention is a pump head. The pump head has a motor coupler; a motor mount; at least one piston housing; a fluid input; a fluid output; and a reciprocating piston operative within said piston housing and in a fluid flow path between said fluid input and said fluid output to pump a fluid from said fluid input to said fluid output.

In a further manifestation of the invention, the manifold has a fluid input bore and a fluid output bore, each extending generally longitudinally parallel to a longitudinal axis of the reciprocating piston, and from adjacent a first longitudinal end of the reciprocating piston to adjacent a second longitudinal end of the reciprocating piston.

In another manifestation of the invention, the motor mount has a first mounting flange having at least one coupling to which a fastener may engage and which is configured to couple the first mounting flange to a motor, and having a torsion sleeve coupled with and extending from the at least one coupling on a first end of the torsion sleeve. A torsion bolt extends from within the torsion sleeve and is coupled with and extends from the at least one piston housing on a first end of the bolt distal to the torsion sleeve. An elastomeric sleeve isolates the torsion bolt from torsion sleeve.

In an additional manifestation of the invention, the torsion bolt is configured to longitudinally compress the elastomeric sleeve and thereby urge the elastomeric sleeve to radially expand towards and against the torsion sleeve.

In another manifestation of the invention, a first seal between the reciprocating piston and the at least one piston housing is in direct fluid communication with a fluid inlet into the piston housing and a fluid output from the piston housing. A second seal is located between the reciprocating piston and the at least one piston housing and is isolated from fluid communication with the fluid inlet into the piston housing and the fluid output from the piston housing by the first seal. The reciprocating piston, at least one piston housing, first seal, and second seal in combination define a fluid collection chamber for fluid that has operatively leaked past the first seal into the fluid collection chamber. A fluid conduit connects the fluid collection chamber to the fluid input.

In an even further manifestation of the invention, an over-pressure release valve assembly is coupled on an input thereof with the fluid output and is configured to stay closed until a predetermined maximum pressure is exceeded, and is in fluid communication on an output thereof with at least one of the fluid inlet or a fluid reservoir.

OBJECTS OF THE INVENTION

The present invention and the preferred and alternative embodiments have been developed with a number of objectives in mind. While not all of these objectives are found in every embodiment, these objectives nevertheless provide a sense of the general intent and the many possible benefits that are available from embodiments of the present invention.

A first object of the invention is to provide a high efficiency, high pressure, very chemical resistant, and long Mean Time Between Failure (MTBF) pump. A second object of the invention is the provision of such a pump that is further self-priming and which is tolerant of a wide range of fluid viscosities. Another object of the present invention is the provision of precise displacement for predictable injection flow rate. A further object of the invention is to provide a pump having a modular assembly designed for easy servicing, such as foreseeable in arctic cold when a service person is wearing mittens, with no handling of small parts, other than bolts and a wrench, required. Yet another object of the present invention is the provision of a relatively compact pump head that slides directly onto a standard motor shaft, with a torque arm incorporated directly into the mounting flange. An additional object of the present invention is to provide a pump that exhibits reduced pulsation, relatively low starting torque, and therefore relatively low starting amperage, thereby facilitating off-grid electrical power such as solar photovoltaic power. Yet another object of the present invention is to conserve and not release fluids being pumped, through a return of leaked and over-pressure released fluid back to an inlet fluid source.

BRIEF DESCRIPTION OF THE DRAWINGS

The foregoing and other objects, advantages, and novel features of the present invention can be understood and appreciated by reference to the following detailed description of the invention, taken in conjunction with the accompanying drawings, in which.

DESCRIPTION OF THE PREFERRED EMBODIMENT

For the following defined terms, these definitions shall be applied, unless a different definition is given in the claims or elsewhere in this specification.

All numeric values are herein assumed to be modified by the term "about", whether or not explicitly indicated. The term "about" generally refers to a range of numbers that one of skill in the art would consider equivalent to the recited value (i.e., having the same function or result).

The recitation of numerical ranges by endpoints includes all numbers within that range (e.g., 1 to 5 includes 1, 1.5, 2, 2.75, 3, 3.80, 4, and 5).

Although some suitable dimensions ranges and/or values pertaining to various components, features and/or specifications are disclosed, one of skill in the art, incited by the present disclosure, would understand desired dimensions, ranges and/or values may deviate from those expressly disclosed.

As used in this specification and the appended claims, the singular forms "a", "an", and "the" include plural referents unless the content clearly dictates otherwise. As used in this specification and the appended claims, the term "or" is generally employed in its sense including "and/or" unless the content clearly dictates otherwise.

For the purposes of the present disclosure, a torque arm will be understood to be a member that prevents the pump head assembly from rotating relative to the motor frame, and instead insures that the all applied torque is applied to fluid pumping.

The following detailed description should be read with reference to the drawings in which similar elements in different drawings are numbered the same. The detailed description and the drawings, which are not necessarily to scale, depict illustrative embodiments and are not intended to limit the scope of the invention. The illustrative embodiments depicted are intended only as exemplary. Selected features of any illustrative embodiment may be incorporated into an additional embodiment unless clearly stated to the contrary.

Figure 1:
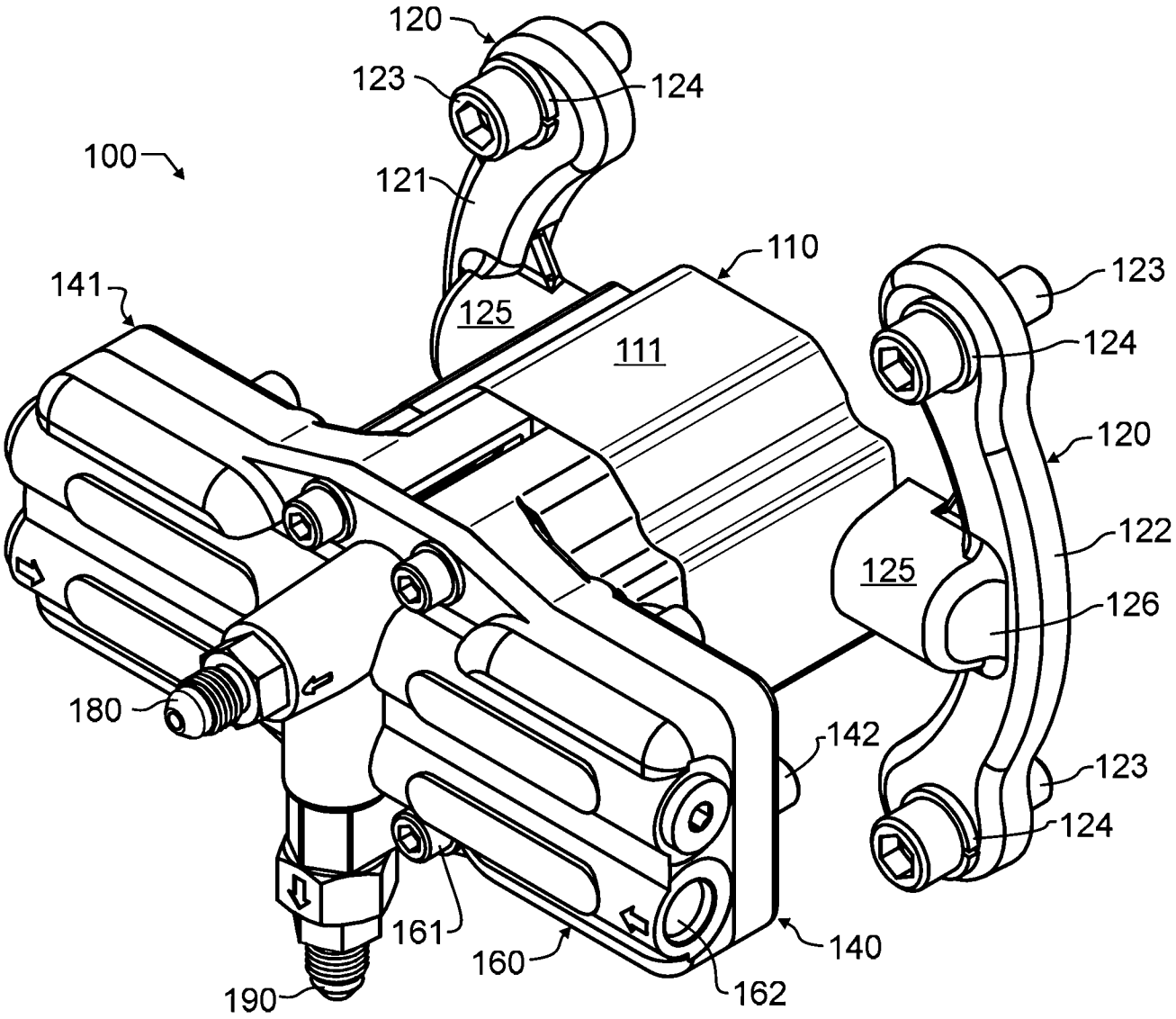
FIG. 1 illustrates a preferred embodiment pump head designed in accord with the teachings of the present invention from a front isometric view.
Figure 2:
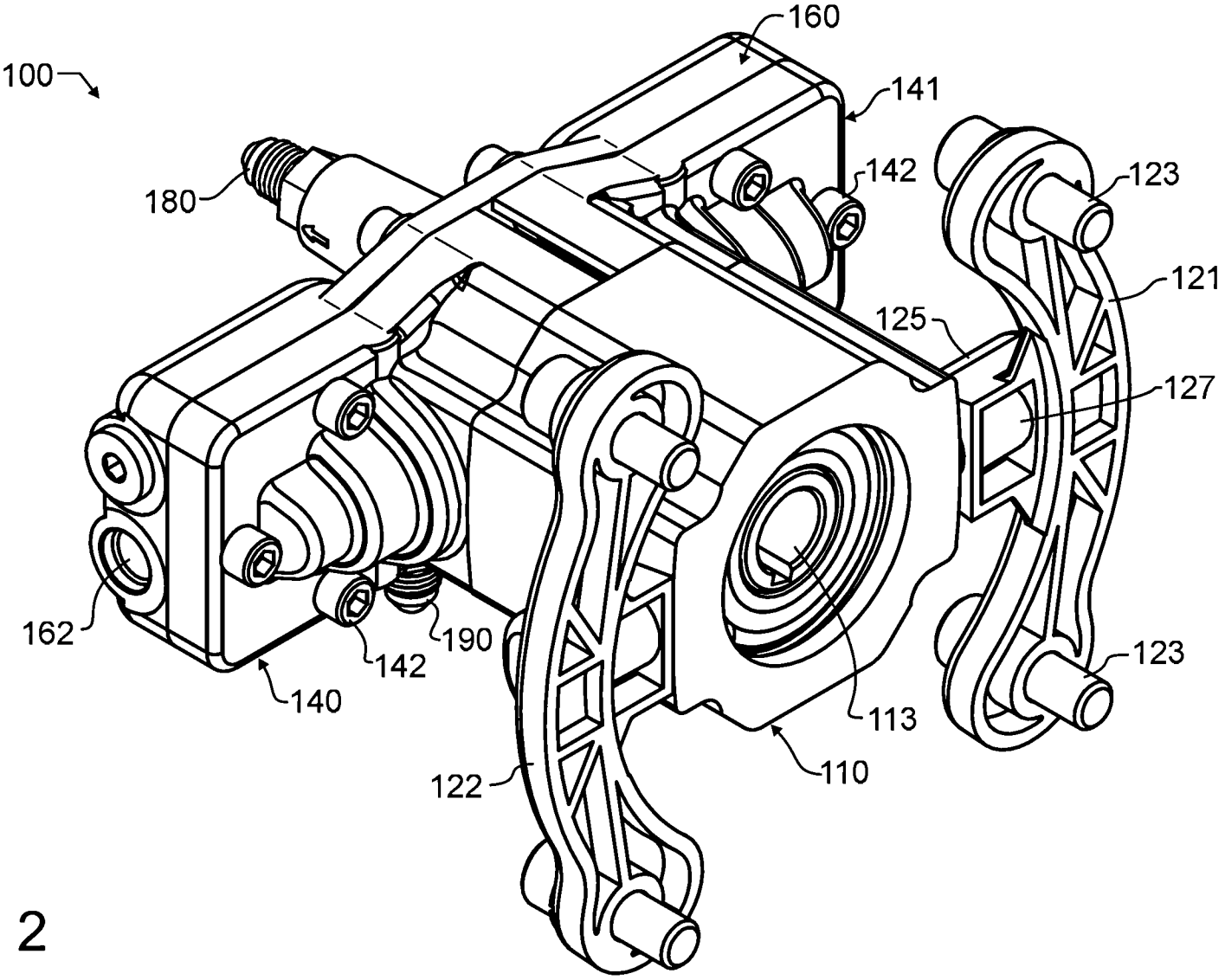
FIG. 2 illustrates the preferred embodiment pump head of FIG. 1 from a rear isometric view.
Figure 3:
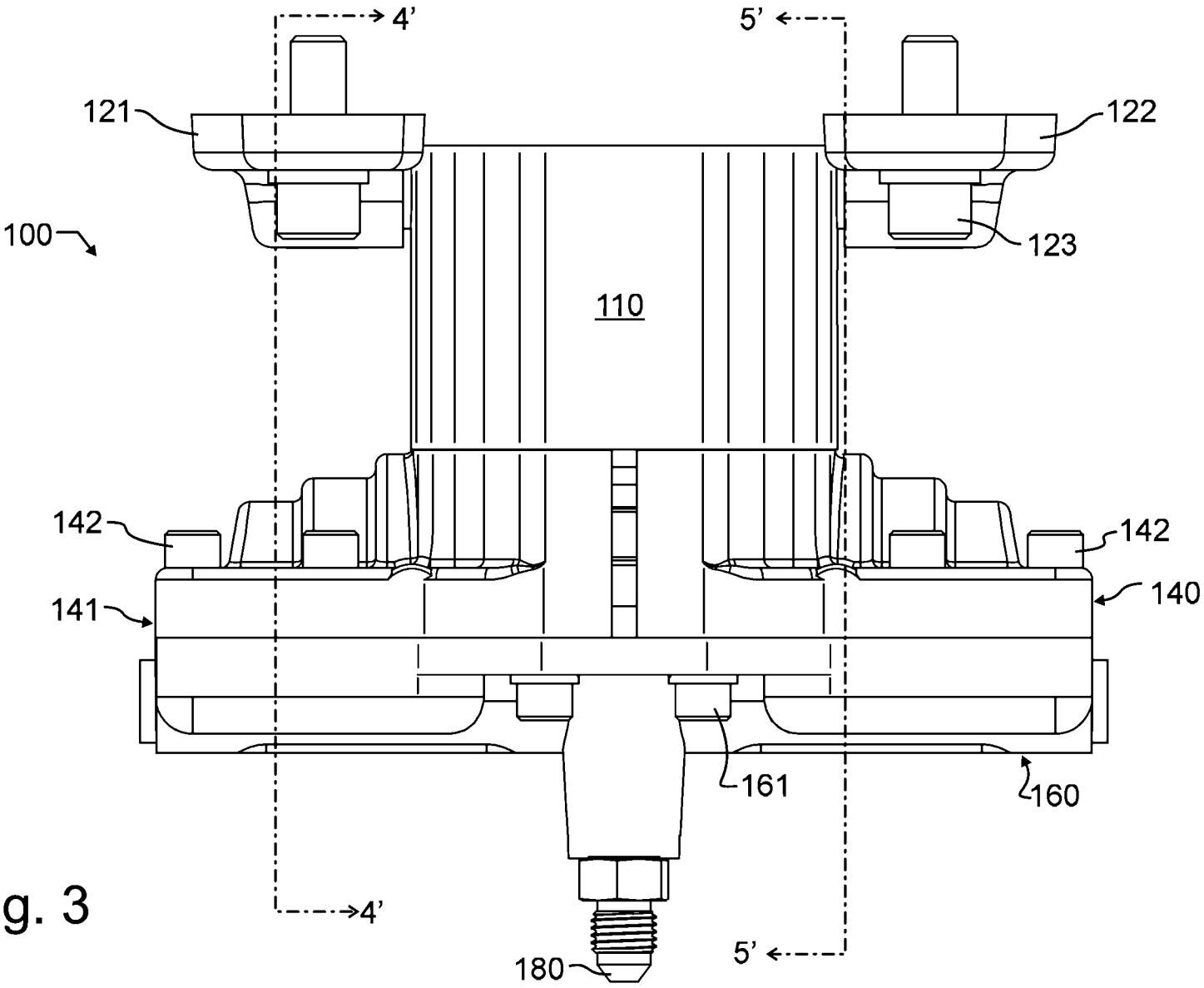
FIG. 3 illustrates the preferred embodiment pump head of FIG. 1 from a top view.

FIGS. 1-3 illustrate pump head 100 in an assembled state. Pump head 100 has a motor coupler 110, motor mount 120, right piston housing 140, left piston housing 141, manifold 160, output 180, and overflow 190.

Motor coupler 110 is configured to couple through coupling body 111 directly with a standard motor shaft, to transmit rotary power from the motor shaft into pump head 100. Motor connection sleeve 113 accomplishes this coupling, which as illustrated is a slotted sleeve that may receive a keyed shaft and associated key therein. Nevertheless, the type of motor connection is not critical to the present invention, and so other known motor couplers will be considered to be incorporated herein. Bearings 114 allow motor connection sleeve 113 to rotate freely within coupling body 111. At the end of motor connection sleeve 113 distal to the motor is a cam coupler 117 that allows motor connection sleeve 113 to engage with and directly drive cam 118. Cam coupler 117 is not centered on the central axis of cam 118. Therefore, as the motor shaft and motor connection sleeve 113 rotate cam 118, the outer periphery of cam 118 does not remain stationary.

Figure 9:
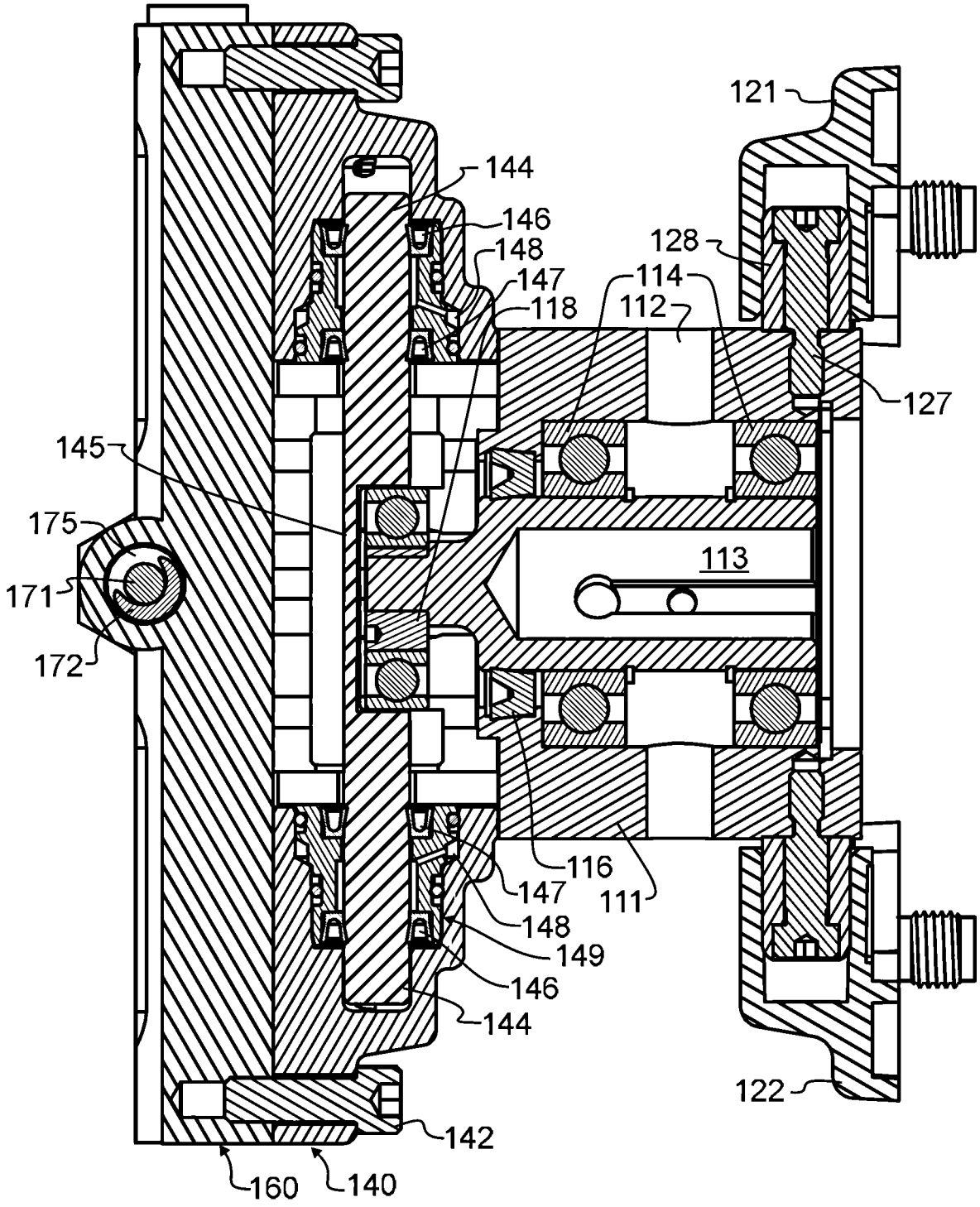
FIG. 9 illustrates the preferred embodiment pump head of FIG. 1 from a horizontal plane sectional view taken along section line 9' of FIG. 8.

Cam 118 is engaged with piston 144 at saddle 145 as illustrated in FIG. 9. Consequently, when cam 118 is rotated by motor connection sleeve 113, it will function as an eccentric that in turn will drive piston 144 in a reciprocating motion, in one extreme position locating piston 144 farther into right piston housing 140 and farther out of left piston housing 141, and in the second extreme position locating piston 144 farther out of right piston housing 140 and farther into left piston housing 141. As piston 144 reciprocates in a horizontal plane, it is prevented from moving vertically up and down by cylinder 143. Nevertheless, cam 118 will of course not only drive left and right, but up and down as well. To permit this movement, while not incurring any consequential energy loss, cam drive bearing 119 encircles cam 118 and has an outside diameter slightly less than the width of saddle 145. Cam drive bearing 119 is thus configured to press against a first side of saddle 145 and climb with respect thereto on a first half rotation, while not contacting the opposite side of saddle 145 during this first half rotation. Bearing 119 will then press against the opposite side of saddle 145 and move downward with respect thereto on a second half rotation, while not contacting the first side of saddle 145.

As described and illustrated, since cam 118 and cam drive bearing 119 are disposed in saddle 145 of piston 144, rotation of cam 118 results in reciprocating motion of piston 144. Thus, one revolution of motor connection sleeve 113 rotates cam 118 one revolution, which in turn results in one stroke of piston 144. A stroke of piston 144 is defined as a single back-and-forth cycle of the piston in which piston 144 travels from its furthest extent in a first direction (e.g., toward left piston housing 141) to its furthest extent in the opposite direction (e.g., toward right piston housing 140) and back to its furthest extent in the first direction.

The volume of fluid output by pump head 100 during one stroke of piston 144 is considered the displacement of pump head 100. The displacement of pump head 100 is a function of the diameter of piston 144 and the stroke length (e.g., longitudinal movement) of piston 144. Thus, in some embodiments the displacement of pump head 100 may be changed by changing the diameter of piston 144 and/or the stroke length of piston 144. In some embodiments, a sleeve may be placed in the piston bore defined by cylinder 143 to accommodate a piston having a smaller diameter. Additionally and/or alternatively, in some embodiments cam 118 may be substituted with another cam having a different eccentricity, such as the opening of the cam being located at a different radial position from the center axis of the cam.

When pump head 100 is operating, rotary motion from the rotary motor shaft is directly coupled to motor connection sleeve 113. Since cam 118 is affixed to motor connection sleeve 113, this rotation also moves cam 118. Owing to the eccentricity of cam 118, movement generates a cantilevered force against motor connection sleeve 113. This force is counteracted by both of the bearings 114, while the rollers within bearings 114 act as anti-friction devices. The direction of the force upon bearings 114 is one for which most bearings are designed to exhibit great strength and minimal wear, meaning that such force does not consequentially diminish the life of properly selected bearings.

Bearing 119 encircles cam 118. During rotation of motor connection sleeve 113, bearing 119 is driven against saddle 145 of piston 144 by cam 118. Cam 118 is therefore also protected from any frictional energy loss and associated component wear by cam drive bearing 119, while still controlling the extent of eccentric movement. Once again, the force upon bearing 119 is in the proper direction for great strength and minimal wear.

In view of the fixed couplings between drive chain members, with the only exceptions being bearings with properly oriented forces, there are no "weak links" in the preferred embodiment drive chain from motor shaft to piston 144. As long as the three bearings 114 and 119 are properly selected to withstand the radial loading described immediately herein above, and to have long life, then pump head 100 will be both extremely efficient, and also quite capable of generating extremely high pressures while still operating for a very extended time period (long MTBF).

Many prior art reciprocating pumps require the use of a return spring to return the piston. However, in the preferred embodiment, the use of cam 118 in combination with cam drive bearing 119 and saddle 145 in piston 144 eliminates the need for a piston return spring. This not only reduces the parts count, it also further improves efficiency and MTBF.

In addition to the drawbacks associated with efficiency and MTBF, a return spring may not always properly return. For exemplary purposes, a highly viscous liquid may delay and ultimately prevent the spring from fully returning the piston. This will alter the amount of fluid actually pumped during a single stroke. In contrast, cam 118 will positively drive piston 144 through the full stroke with each revolution, ensuring that the correct amount of fluid is actually pumped in any given stroke.

In the most demanding applications, such as, for exemplary and non-limiting purposes, pipeline chemical injection pumps, both efficiency and MTBF are particularly critical, and even small improvements can translate into substantial cost savings over the life of the pump head. This is in part due to the very nature of the remote installation, making the cost to access and repair or replace a pump very high. Ideally, a preferred embodiment pump head 100 would be permanent for the life of the pipe line, thereby substantially lowering the annual and lifetime cost to operate the preferred embodiment pump head 100.

Piston 144 with saddle 145 as disclosed herein is functionally identical to and structurally very similar to piston 44 illustrated and described in U.S. Pat. No. 9,316,216 by Cook et al, owned by the present assignee, and incorporated by reference herein above. Therefore, further illustration and understanding of the operation of this cam, saddle and piston may be gleaned therefrom.

Motor mount 120 replaces and improves upon traditional hat-brim style pump head mounting flanges. These traditional mounting flanges have holes drilled at intervals around the brim region, and through the holes are affixed bolts to secure the pump head to a collar about the motor. Unfortunately, such prior art flanges do not accommodate any dimensional deviations that might, for exemplary purpose, lead to axial mis-alignment between motor connection sleeve 113 and the motor shaft. Furthermore, the prior art rigid coupling also necessitates higher starting torque, greater pulsation of drive, pump, and pumped fluid, and increased vibration transmission between motor and pump head. Higher starting torque is disadvantageous for starting amperage, making the prior art less conducive for use in non-grid applications such as solar powered pumping stations. The high starting torque of the prior art also increases peak forces on the moving components, which accelerates wear and decreases MTBF.

In distinct contrast to the prior art brim, the present invention provides a motor mount 120 having a left mounting flange 121 and right mounting flange 122. The particular number of mounting flanges is not critical to the present invention, though at least two are preferred to better accommodate dimensional tolerances or other mismatches that may arise. Motor mounting bolts 123 are used to rigidly and securely fasten motor mount 120 to a motor, and lock washers 124 or any other method of securing fasteners may be provided to ensure that motor mounting bolts 123 do not unintentionally loosen over time.

In the rare event that field service is required, and particularly in remote arctic locations, the service person may be working in extreme sub-zero conditions. In some prior art designs, this will require the service person to handle and precisely place small parts. This may be easily accomplished in the controlled environment of an office building or factory, but in extreme sub-zero conditions even the most manually dextrous persons will find the chore impossible. Most commonly in such a hostile environment, the service person will be wearing thick mittens to protect hands, and small parts simply cannot be manipulated.

In contrast, the preferred embodiment is designed so that pump head 100 may be removed as a single unit and replaced with another like pump head. This will only require the removal of the motor mounting bolts 123 and input and output fluid couplers that connect to input connector 162 and output 180 respectively, followed by sliding of motor connection sleeve 113 from the motor shaft, and then installation of the replacement pump head including sliding of motor connection sleeve 113 onto the motor shaft, and subsequent replacement or reinstallation of the removed motor mounting bolts and fluid couplers. This can all be done easily by a service person wearing mittens and outfitted with an allen wrench or the like. While this may seem at first blush to be minor, again, in extreme sub-zero conditions, preferred motor mount 120 can be critical.

Torsion sleeve 125 provides an outer rigid sleeve through which torsion bolt 127 will pass. Separating the two is a rubber or otherwise elastomeric torsion sleeve 128 which is configured to reduce vibration from passing through, and allowing peak impulses of torsional energy to be stored and later released. As may best be appreciated from FIG. 9, the head of torsion bolt 127 extends at least across a shoulder within elastomeric torsion sleeve 128. In a contemplated alternative embodiment, the head of torsion bolt 127 may extend partially, but not completely, across the end of elastomeric torsion sleeve 128. In either case, when torsion bolt 127 is tightened into coupling body 111, this will cause elastomeric torsion sleeve 128 to compress longitudinally, and in turn expand radially. As may be appreciated then, prior to compression, elastomeric torsion sleeve 128 may fit easily within torsion sleeve 125. However, when compressed by torsion bolt 127, elastomeric torsion sleeve 128 will radially expand and compress against torsion sleeve 125, thereby firming the connection between the associated mounting flange 121, 122 and coupling body 111.

While a sleeve geometry is described and illustrated for elastomeric torsion sleeve 128, it will be appreciated that other geometries that accomplish the intended isolation between torsion sleeve 125 and torsion bolt 127 are also contemplated herein. The elastomeric isolation means that peak rotational forces are dampened, while torsion sleeve 125 still functions as a torsion arm. Reducing peak rotational forces not only helps to increase Mean Time Between Failure (MTBF), it also reduces peak current draw of the motor, making the motor more suitable to use in solar powered and other applications sensitive to peak current draw. This also helps to reduce pulsation within the pumped fluid, by smoothing out the piston drive force. In the event of catastrophic failure of rubber torsion sleeve 128, which is highly unlikely due to the fact that forces applied thereto are entirely compressive in nature, torsion bolt 127 will still be constrained by and within torsion sleeve 125. This constrainment helps to ensure that pump head 100 will not be consequentially harmed or destroyed, even if rubber torsion sleeve 128 catastrophically fails.

An optional cap 126 may be provided to enclose torsion bolt 127, thereby reducing the chance that a service person would mistakenly remove torsion bolts 127 rather than removing motor mounting bolts 123, in the rare event that service is required. Once again, this may at first blush appear to be minor, but in extreme sub-zero conditions, this can be critical.

FIGS. 4-9 illustrate the internal fluid passages and piston operation in greater detail. Right piston housing 140 and left piston housing 141 each provide a central bore that defines cylinder 143 through which piston 144 travels in reciprocating motion. Manifold anchor bolts 142 are provided to secure manifold 160 to each of the piston housings 140, 141. As already described herein above with reference to FIG. 9, a recess or saddle 145 in piston 144 serves to engage with cam drive bearing 119 and transmit rotary motion from a motor shaft through to piston 144. Continuing with FIG. 9, when piston 144 reciprocates within cylinder 143, at each end thereof piston housings 140, 141 define chambers that are alternately being compressed and being vacuumed. To maintain this alternating compression and vacuum, a pair of high pressure piston outer seals 146, also visible in FIG. 9, are provided.

When these high pressure piston outer seals 146 are functioning perfectly, there will be no leakage of the pumped fluid past. However, over time even tiny amounts of leakage may tend to accumulate. Further, and with proper design and construction only with very great aging of components, piston outer seals 146 may begin to or completely fail. In such instances, it is desirable to avoid any accumulation of fluids.

Figure 5:
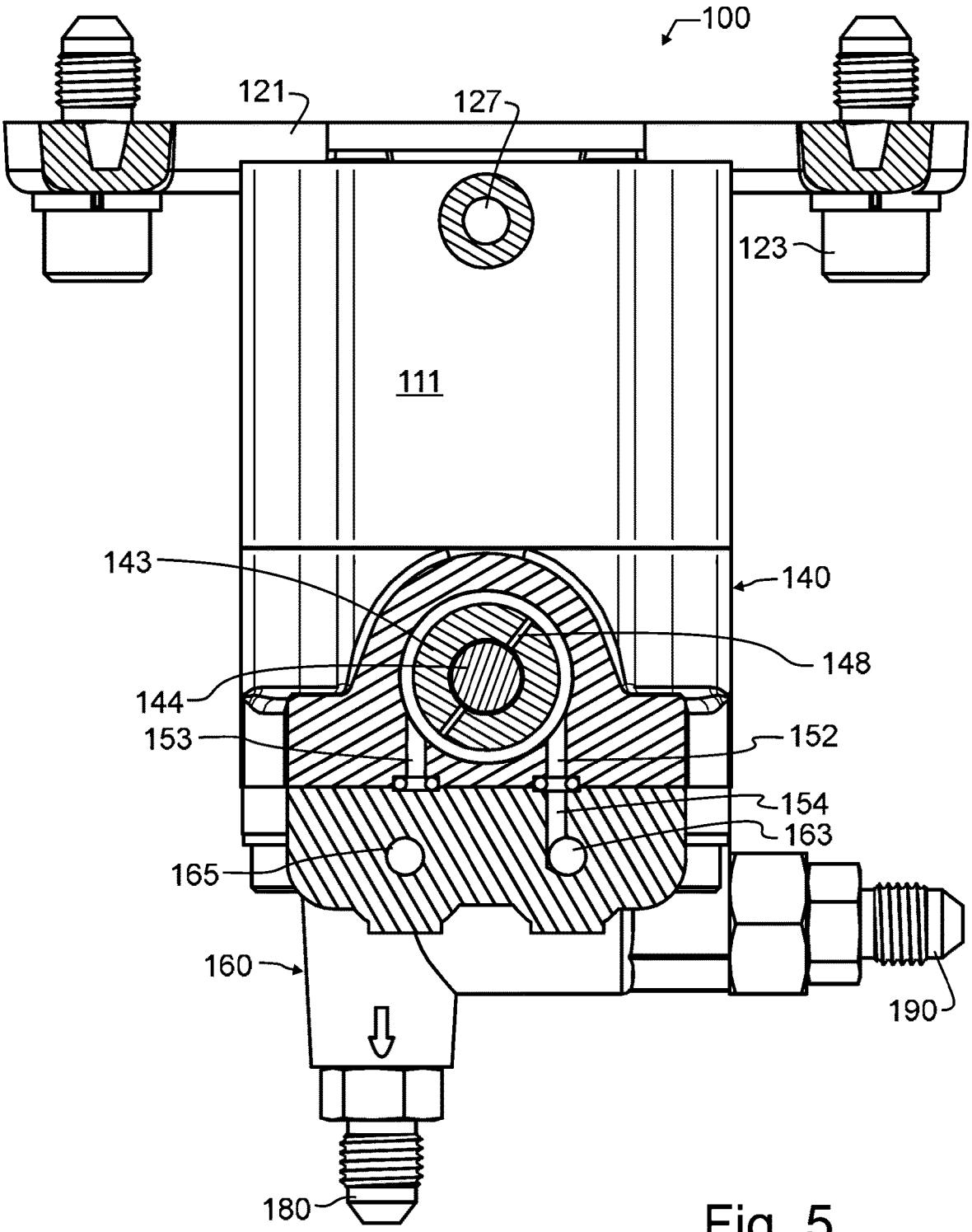
FIG. 5 illustrates the preferred embodiment pump head of FIG. 1 from a vertical plane sectional view taken along section line 5' of FIG. 3.
Figure 6:
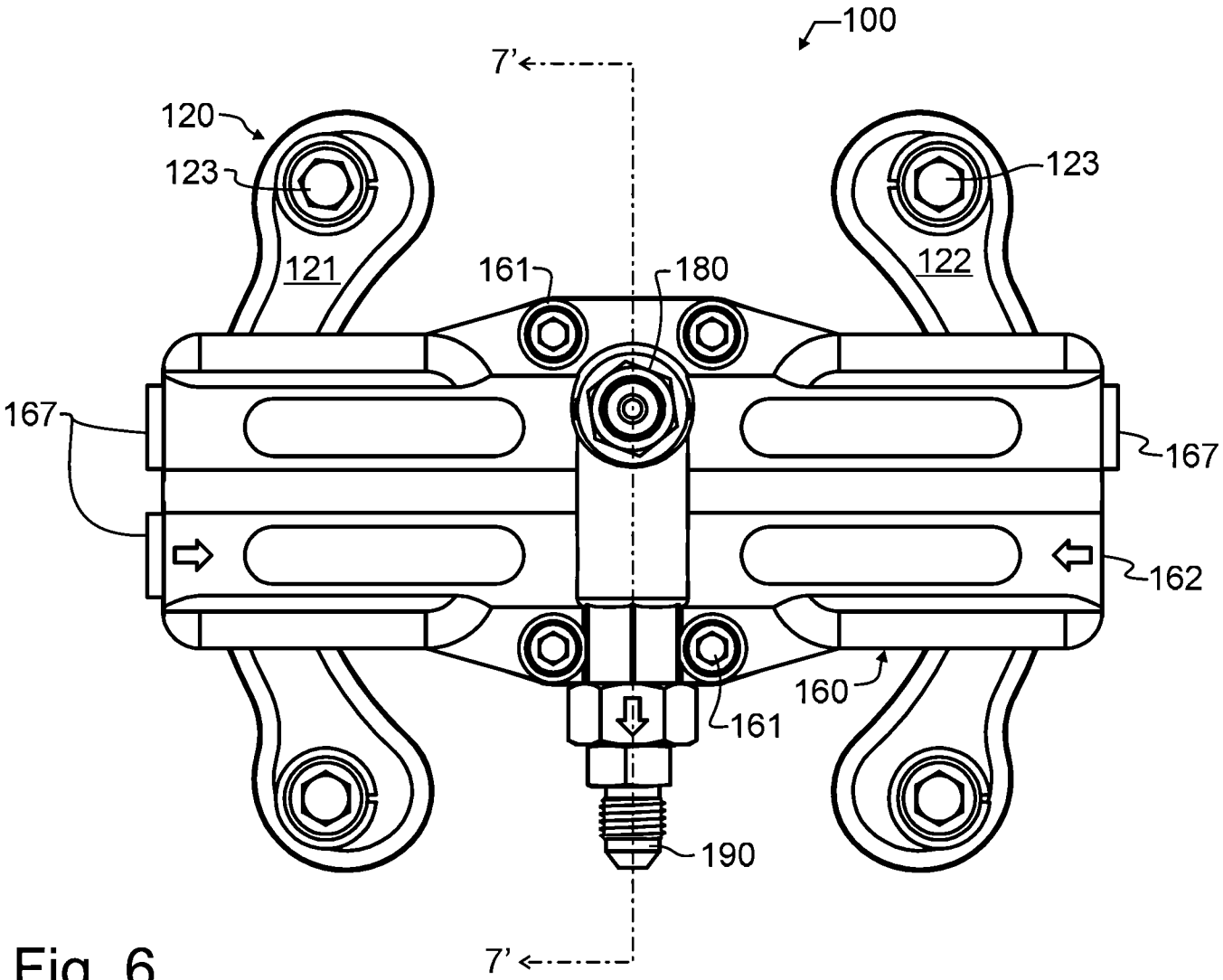
FIG. 6 illustrates the preferred embodiment pump head of FIG. 1 from a front view.

A pair of piston inner seals 147 are provided that together with high pressure piston outer seals 146 define a chamber that collects any fluid bypassing high pressure piston outer seals 146. This fluid is then conducted through piston bypass drain bore 148, visible in FIG. 9, to bypass passages 152, 153. Turning now to FIG. 5, one of bypass passages 152, 153 connects with bypass bore 154 in manifold 160, which in turn ultimately connects with input bore 163 and from there to the input supply line and fluid source reservoir. As visible in FIG. 5, bypass passage 152 within right piston housing 140 connects to bypass bore 154, and bypass passage 153 terminates at the face of manifold 160. Noteworthy here is that right and left piston housings 140, 141 are fabricated with identical geometry, and are simply rotated through a half-circle relative to each other at the time of installation. This means that while bypass passage 152 within right piston housing 140 connects to bypass bore 154, and bypass passage 153 terminates, in left piston housing 141 bypass passage 153 connects to bypass bore 154, and bypass passage 152 terminates.

Figure 4:
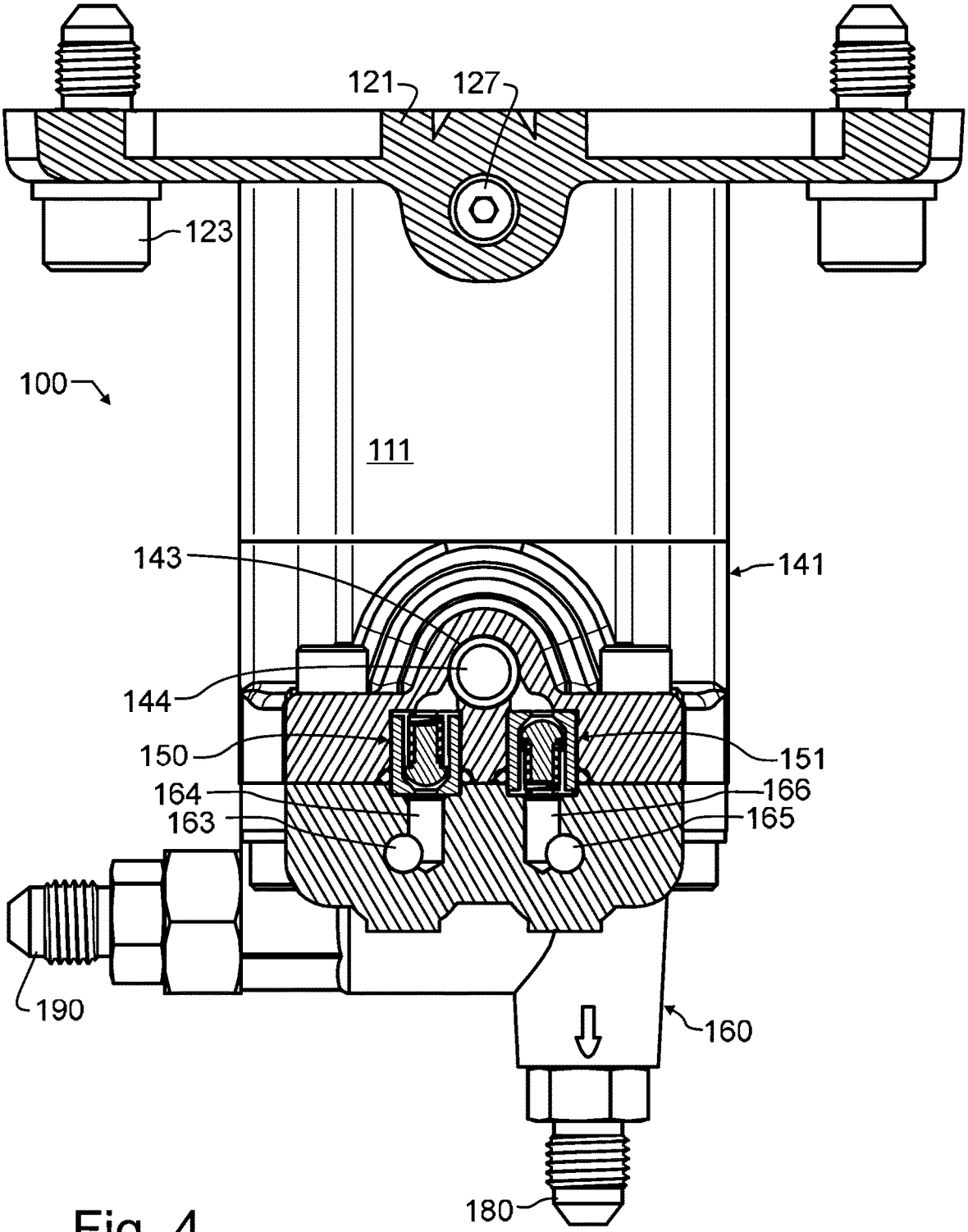
FIG. 4 illustrates the preferred embodiment pump head of FIG. 1 from a vertical plane sectional view taken along section line 4' of FIG. 3.

Turning to FIG. 4, input check valve assembly 150 couples piston 144 to input to piston housing bore 164, which in turn couples to input bore 163. Input check valve assembly 150 is a one-way check valve, assuring that during movement of piston 144 in a first direction (away as viewed in FIG. 4), fluid is drawn into cylinder 143. However, when piston 144 changes direction and moves towards the reader in FIG. 4, input check valve assembly 150 will close preventing fluid from undesirably being pumped back into the inlet bore 163. Instead, output check valve assembly 151 will now open, allowing fluid within cylinder 143 to be pumped through output check valve assembly 151 and onward through the output to piston housing bore 166 and then to output bore 165. The combination of piston 144 with good high pressure piston outer and inner seals 146, 147, along with good high pressure input and output check valve assemblies 150, 151 ensures generation of adequate vacuum on the inlet side to be both self priming for nearly all materials, and to be compatible through a wide range of viscosities as well. This in turn helps to ensure that the preferred embodiment will not require human intervention to start fluid flow, even through very diverse ambient temperatures, and with a very wide range of fluid chemical compositions.

Manifold 160 supports piston housings 140, 141, through manifold anchor bolts 142 that pass through the piston housings and secure into manifold 160. In turn, anchor bolts 161 couple manifold 160 and to motor coupler 110, and in the process sandwich piston housings 140, 141 between.

Manifold 160 is provided with an input connector 162, which as illustrated comprises a female threaded connector. Nevertheless, any suitable fluid connector may be used, and the female threaded connector is purely exemplary. Input connector 162 is in fluid communication with input bore 163, thereby ensuring that fluid arriving from a fluid reservoir through input connector 162 will be passed through to input bore 163, then to the input to piston housing bore 164, and then alternately into distal ends of cylinder 143.

A plurality of caps 167 may be used to terminate the main bores in manifold 160, which are the input bore 163 and output bore 165, leaving only a single input connector 162 supplying fluid into pump head 100. As long as input bore 163 runs essentially the entire length of manifold 160, then input supply fluid will be delivered to both right piston housing 140 and left piston housing 141, adjacent to opposed ends of piston 144. This allows pump head 100 to operate as a double acting simplex positive displacement pump, which means that pump head 100 will be pumping in both directions of piston movement, for the entire motor shaft rotation. Some examples of double acting simplex positive displacement plunger pumps are described in U.S. Pat. Nos. 4,978,284, 5,173,039, 5,183,396, 6,257,843 and 6,527,524 owned by the present assignee, the disclosures of which are incorporated herein by reference.

Fittings, such as hose fittings, may be coupled to the inlet and outlet bores of the manifold as desired to couple fluid inlet and fluid outlet lines (e.g., hoses, pipes, etc.) to pump head 100. Such fittings may include elbows, tees, reducers, couplers, caps, ball valves, stopcock valves, or any other suitable or desirable coupling. Further, various instrumentation or other apparatus may also optionally be coupled into pump head 100 either through input connector 162 and output 180, or at any other suitable location or access point. As but one non-limiting but illustrative example, one or more of caps 167 may be removed to affix instrumentation such as pressure gauges or any other suitable or desired instrumentation.

Figure 7:
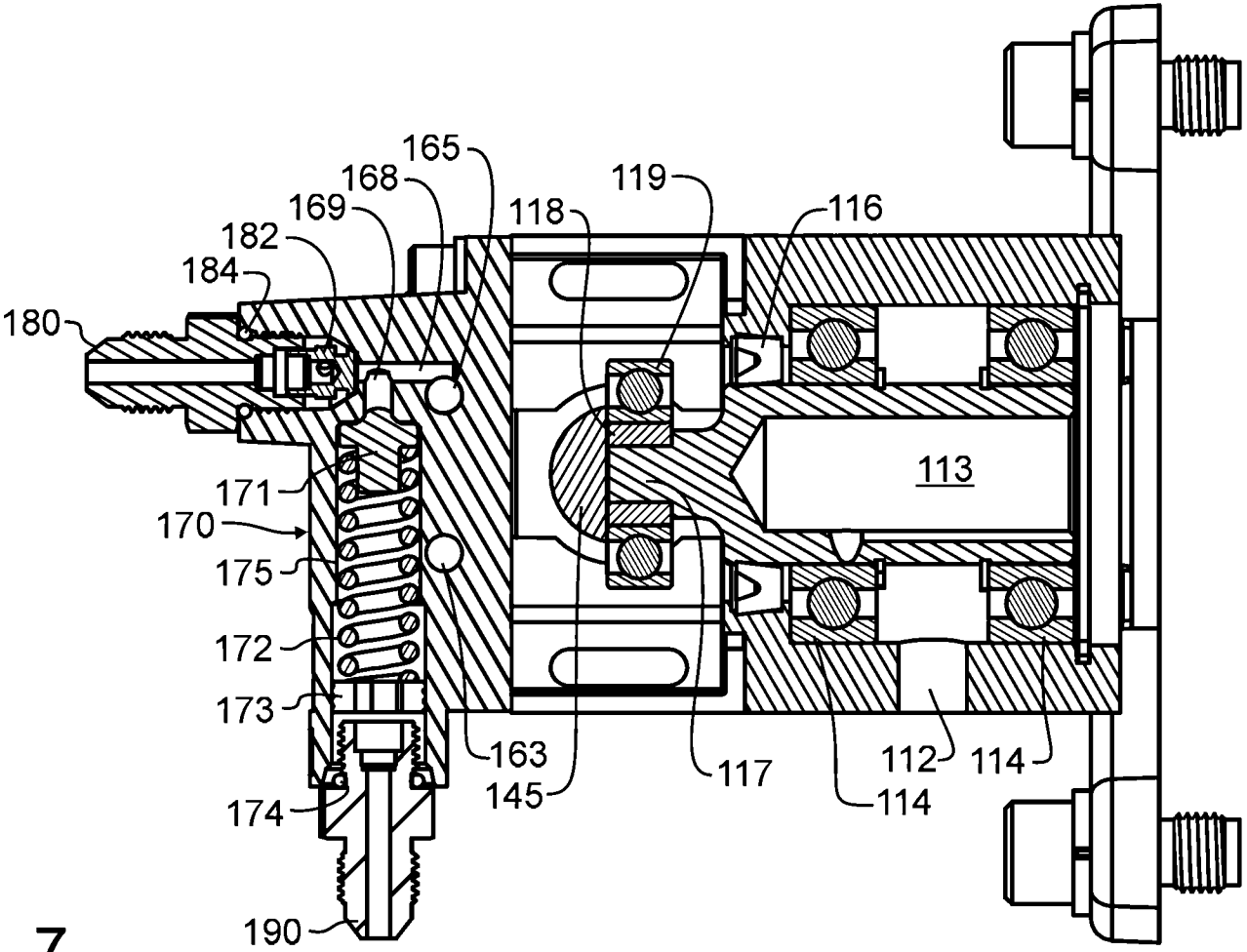
FIG. 7 illustrates the preferred embodiment pump head of FIG. 1 from a vertical plane sectional view taken along section line 7' of FIG. 6.
Figure 8:
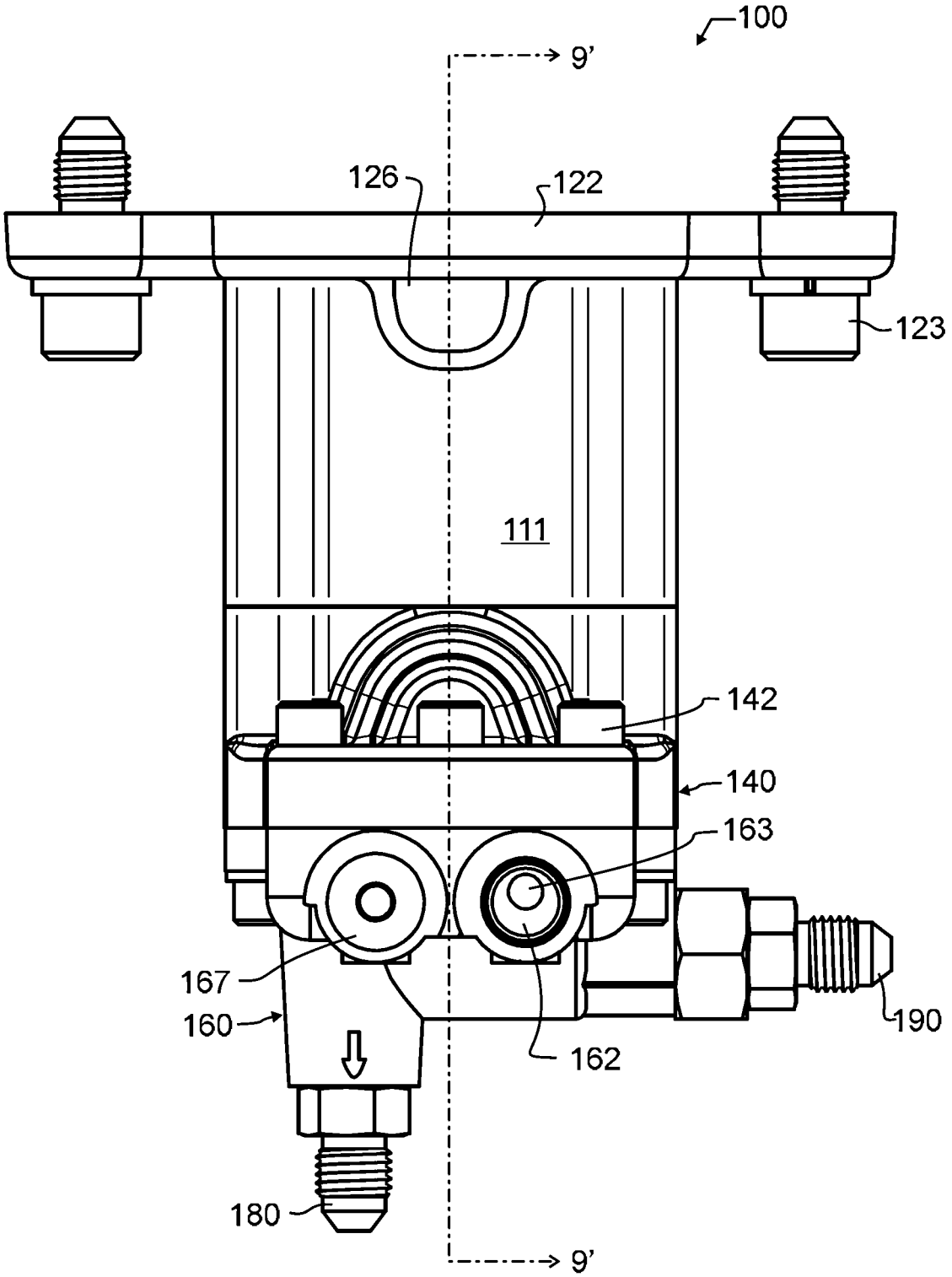
FIG. 8 illustrates the preferred embodiment pump head of FIG. 1 from a right side view.

As illustrated in FIG. 7, output bore 165 which runs transverse to the motor shaft longitudinal axis is in free fluid communication with output axial bore 168, which runs parallel to the motor shaft longitudinal axis. Fluid traveling out of pump head 100 through output 180 will first pass through back flow valve 182, which as the name suggests will simply ensure that fluid only passes out of pump head 100 at output 180, and not back in. An o-ring seal 184 or the like may be provided to provide a leak-free seal between the output nipple and manifold 160.

While for normal operation, the aforementioned output is adequate, there may be unforeseeable circumstances where a blockage develops in plumbing external to pump head 100, such as for exemplary purposes a natural gas pipeline, or where blockage develops in the plumbing coupling piston 144 to the external plumbing, such as through failure of back flow valve 182 to open. In such cases, the continued reciprocation of piston 144 will quickly increase pressure from piston 144 through the output bore 165 and to the point of blockage to dangerous levels that can lead to ruptures in the plumbing, or permanent damage to pump head 100 or to a motor such as motor 10 illustrate in FIG. 10. To prevent or greatly reduce the likelihood of such damage, an output to over-pressure bore 169 couples output axial bore 168 to over-pressure release valve assembly 170. Over-pressure valve assembly 170 is configured to stay closed until a predetermined maximum pressure is exceeded. For exemplary purposes, this pressure threshold may be selected to ensure that at no time will the pump head exceed a maximum safe pressure. Over-pressure valve assembly 170 comprises an over-pressure release ball 171, over-pressure release spring 172, and over-pressure release end stop 173. When the pressure threshold of over-pressure valve assembly 170 is exceeded, then over-pressure release ball 171 will be pushed with sufficient force to overcome the opposing force provided by over-pressure release spring 172, and thereby unseat over-pressure release ball 171. This permits pressurized fluid within output axial bore 168 to pass through over-pressure valve assembly 170 and within internal bore 175, thereby lowering the pressure within axial bore 168 to an acceptable level. An over-pressure release end stop 173 is provided that maintains the compression of over-pressure release spring 172. In a preferred embodiment, over-pressure release end stop 173 is at a fixed distance from over-pressure release ball 171, and therefore sets a fixed activation pressure for opening over-pressure valve assembly 170. Nevertheless, in an alternative embodiment contemplated herein, over-pressure release end stop 173 may be adjustable to be either closer to or farther from over-pressure release ball 171, in which case the activation pressure for opening over-pressure valve assembly 170 may thereby also be adjustable.

An o-ring seal 174 may be provided to seal an overflow output nipple 190 to manifold 160. Most preferably, overflow output nipple 190 will be in fluid communication with at least one of the fluid reservoir, fluid input line, input connector 162, or input bore 163. This may, for exemplary and non-limiting purpose, be achieved through external tubes and fittings that affix to overflow output nipple 190. As may be apparent then, if there is a blockage preventing fluid from being pumped through output 180, piston 144 will simply draw fluid from the fluid reservoir, and return the fluid back to the reservoir via overflow output nipple 190.

Figure 10:
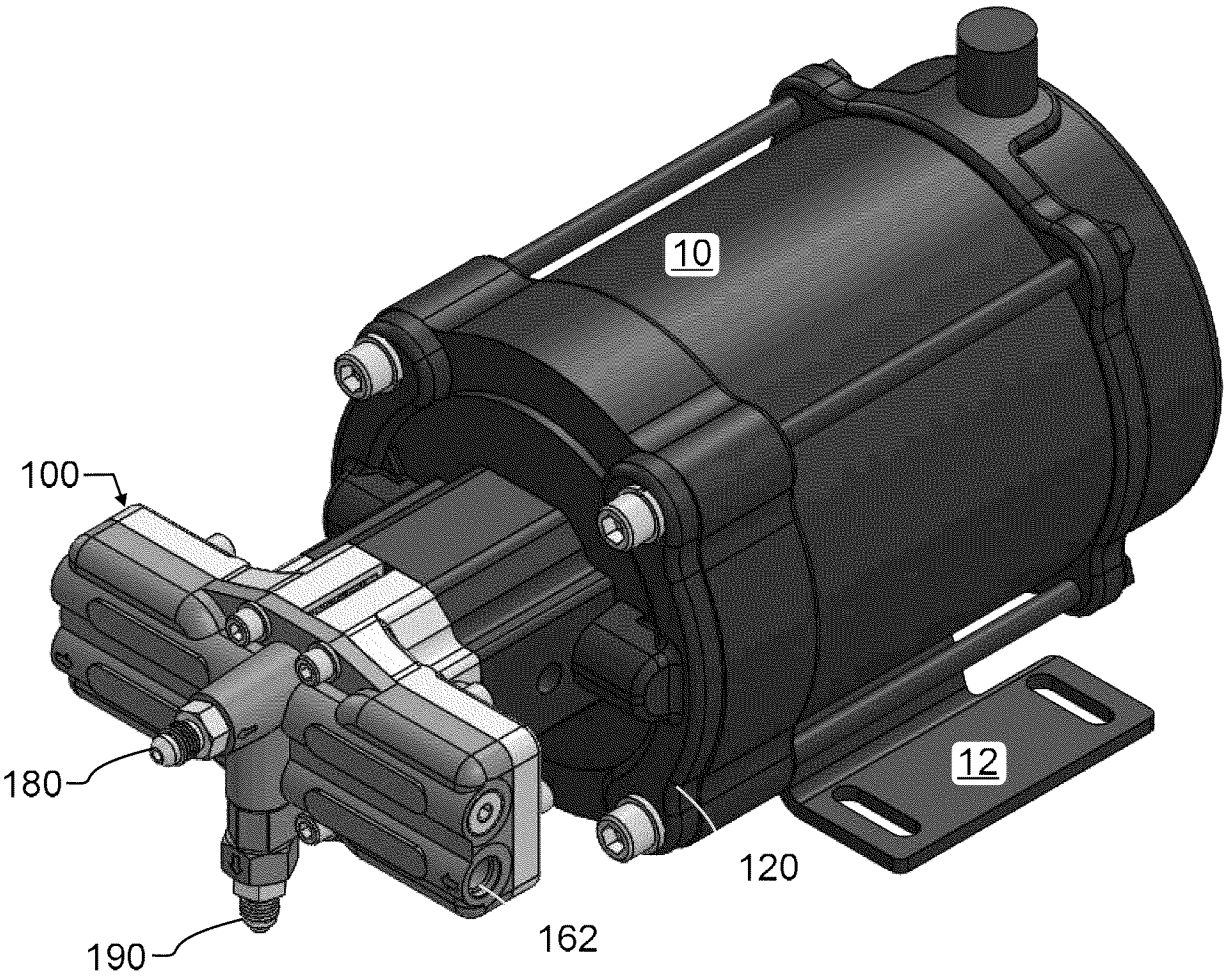
FIG. 10 illustrates the preferred embodiment pump head of FIG. 1 in further combination with a prior art motor from a front isometric view.

FIG. 10 illustrates preferred embodiment pump head 100 in further combination with a prior art motor 10. While an electric motor is illustrated and preferred, the present invention is not solely limited thereto, and other types of motors may be used in alternative embodiments.

Motor 10 may, for exemplary and non-limiting purposes, be provided with some type of motor mounting bracket, such as motor mounting bracket 12 illustrated. Pump head 100 is securely affixed to motor 10 by sliding motor connection sleeve 113 onto the motor shaft (not visible), and then affixing motor mounting bolts 123 into motor 10, for exemplary purposes such as at threaded mounting holes provided in the motor collar. As may be apparent, the exact number, spacing, size, and coupler type of motor mounting bolts 123 will vary depending upon the type of coupler provided with motor 10.

As visible in FIG. 9, motor connection sleeve 113 may optionally have one or more threaded holes formed therein to accommodate a set screw. If this set screw hole is aligned with access hole 112 visible for example in FIG. 7, or a similar optional access hole such as illustrated in FIG. 9, then an installer may also secure motor connection sleeve 113 to the motor shaft using such as set screw.

In an alternative embodiment contemplated herein, a clutch or transmission maybe connected between electric motor 10 and motor connection sleeve 113 to control or alter the transmission of power from electric motor 10 into pump head 100. As used herein, a transmission will be understood to be an assembly of associated parts by which rotational power is converted from a first rotational speed or rate at the power input of the transmission to a second possibly different rotational speed or rate at the power output of the transmission. As used herein the terms "speed" or "rate" may refer to a fixed speed or rate or a variable speed or rate unless the content clearly dictates otherwise.

In some embodiments, the transmission may include one or more chains and sprockets, one or more belts and pulleys, one or more gears, etc. used to alter the output speed from the input speed. In some embodiments, the transmission may be a speed reduction, such as a gear reduction including one or more gears reducing the rotational rate of the output shaft from the rotational rate of the input shaft, while in other embodiments the transmission may be a speed accelerator, such as a gear accelerator including one or more gears increasing the rotational rate of the output shaft from the rotational rate of the input shaft.

In addition to the provision of a transmission, or alternatively thereto, in some embodiments of the invention, motor 10 may be configured to run at more than one speed. The speed may for exemplary purpose be varied by a speed controller or switch.

Pump head 100 may be manufactured from a variety of materials, including metals, resins and plastics, ceramics, or even combinations or composites of the above. The specific material used may vary, though special benefits are attainable if several important factors are taken into consideration. First, anticipated chemical exposure associated with a particular application may dictate material choice. There are many chemicals that are corrosive to ordinary carbon steel, and in such instances, various ceramics and stainless steel compositions are preferred. Additionally, there are a variety of polymers that are also relatively chemically inert. However, few polymers have the combination of strength and temperature resistance that most of the components of the present invention demand for most applications. One notable exception is the material used for the various seals described herein above, where there are several known polymers and natural and synthetic rubber compositions that might be selected, again depending upon the specific requirements of an application. In addition to chemical resistance, temperature resistance, strength, abrasion resistance, and other known factors will be considered. As may be apparent then, it is preferable that all materials are sufficiently tough and durable to not fracture, even when great forces are applied thereto. In the case of preferred embodiment pup head 100, a preferred material for the majority of components is stainless steel, which offers great strength and excellent corrosion resistance against a wide variety of chemicals. While stainless steel might be suitable for some applications as the material used to fabricate piston 144, various ceramics known in the pump industry may be preferable. Consequently, for application to extreme conditions and a wide range of chemical compositions, particularly such as may be encountered in the demanding application of chemical injection pump connected to a natural gas pipeline, a combination of ceramic piston, chemically inert polymer seals, and the vast majority of remaining components fabricated from stainless steel is preferable. Nevertheless, those skilled in the art will readily understand the requirements in light of the present disclosure for a given application, and so will be able to select a suitable set of compositions.

While the foregoing details what is felt to be the preferred embodiment of the invention and many alternatives thereto, no material limitations to the scope of the claimed invention are intended. Further, features and design alternatives that would be obvious to one of ordinary skill in the art are considered to be incorporated herein. The scope of the invention is set forth and particularly described in the claims herein below.

I claim:

1. A pump head, comprising:

a motor coupler having a coupling body and a motor connection sleeve, said motor connection sleeve configured to detachably couple with a rotary motor shaft, said rotary motor shaft defining a motor shaft rotary axis;

a motor mount;

at least one piston housing;

a fluid input;

a fluid output;

and a reciprocating piston within said piston housing and in a fluid flow path between said fluid input and said fluid output configured to pump a fluid from said fluid input to said fluid output;

said motor mount having a first mounting flange which is configured to couple said pump head to a motor;

said first mounting flange having a motor mounting bolt having a longitudinal axis parallel to said motor shaft rotary axis and perpendicular to an axis along which said reciprocating piston reciprocates, said motor mounting bolt passing through said first mounting flange and configured to securely affix to said motor, a first coupling to which a torsion bolt is engaged, a torsion sleeve coupled with and extending from said first coupling on a first end of said torsion sleeve, said torsion sleeve extending longitudinally along an axis perpendicular to said motor mounting bolt and radially out from said motor connection sleeve, and an elastomeric sleeve internal to and longitudinally co-extensive with said torsion sleeve, said torsion bolt having an enlarged head end engaged with said elastomeric sleeve, a shaft extending from within said torsion sleeve, and a threaded end distal to said enlarged head end secured with and extending from said coupling body, said torsion bolt configured to longitudinally compress and thereby urge a radial expansion of said elastomeric sleeve when said torsion bolt is driven into said coupling body to thereby firm a connection between said first mounting flange and said coupling body, said elastomeric sleeve isolating said torsion bolt from said torsion sleeve.

2. The pump head of claim 1, wherein said motor mount further comprises:

a second motor mounting bolt having a longitudinal axis parallel to said motor shaft rotary axis and perpendicular to said axis along which said reciprocating piston reciprocates, said second motor mounting bolt passing through said first mounting flange at a location on said first mounting flange more distal from said first motor mounting bolt than said first coupling and configured to couple said first mounting flange to said motor.

3. The pump head of claim 1, wherein said motor mount further comprises:

a second mounting flange having a second mounting flange motor mounting bolt having a longitudinal axis parallel to said motor shaft rotary axis and perpendicular to said axis along which said reciprocating piston reciprocates, said second mounting flange motor mounting bolt passing through said second mounting flange and configured to securely affix to said motor, a second coupling to which a second torsion bolt is engaged;

a second torsion sleeve coupled with and extending from said second coupling on a first end of said second torsion sleeve, said second torsion sleeve extending longitudinally along an axis perpendicular to said second mounting flange motor mounting bolt, radially out from said motor connection sleeve, and angularly offset from said first torsion sleeve, a second elastomeric sleeve internal to and longitudinally co-extensive with said second torsion sleeve, and said second torsion bolt having an enlarged head end engaged with said second elastomeric sleeve, a shaft extending from within said second torsion sleeve, and a threaded end distal to said enlarged head end secured with and extending from said coupling body, said second torsion bolt configured to longitudinally compress and thereby urge a radial expansion of said second elastomeric sleeve when said second torsion bolt is driven into said coupling body to thereby firm a connection between said second mounting flange and said coupling body, said second elastomeric sleeve isolating said second torsion bolt from said second torsion sleeve.

4. The pump head of claim 1, further comprising a cap enclosing said torsion sleeve, and thereby configured to operatively prevent access to said torsion bolt.

* * * * *